US007133633B2

(12) United States Patent
Fukuda et al.

(10) Patent No.: US 7,133,633 B2
(45) Date of Patent: Nov. 7, 2006

(54) IMAGE FORMING APPARATUS WITH PAPER SEPARATOR-FIXING ROLLER GAP MECHANISM

(75) Inventors: Masahiro Fukuda, Tokyo (JP); Tatsuya Murakami, Tokyo (JP); Masato Sakai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 110 days.

(21) Appl. No.: 10/889,183

(22) Filed: Jul. 13, 2004

(65) Prior Publication Data

US 2005/0013638 A1 Jan. 20, 2005

(30) Foreign Application Priority Data

Jul. 18, 2003 (JP) ..... 2003-198877

(51) Int. Cl.
*G03G 15/20* (2006.01)

(52) U.S. Cl. ..... 399/323

(58) Field of Classification Search ..... 399/323, 399/406, 398, 399

See application file for complete search history.

(56) References Cited

U.S. PATENT DOCUMENTS 5,532,810 A * 7/1996 Cahill ..... 399/323
2003/0081970 A1 5/2003 Yamamoto et al.

FOREIGN PATENT DOCUMENTS

| | | |
|---|---|---|
| JP | 53070827 A | 6/1978 |
| JP | 63188177 A | 8/1988 |
| JP | 06-230699 | 8/1994 |
| JP | 2003107947 A | 4/2003 |
| JP | 2003-202767 | 7/2003 |

OTHER PUBLICATIONS

Machine translation of Japanese patent JP 06-230699.*

* cited by examiner

*Primary Examiner*—David M. Gray
*Assistant Examiner*—Ruth N. LaBombard
(74) *Attorney, Agent, or Firm*—Rabin & Berdo, PC

(57) ABSTRACT

A fixing apparatus includes a fixing roller, a separator, and spacers. The fixing roller is heated while rotating. The fixing roller is in pressure contact with a recording medium that is advancing so that the developer deposited on the recording medium is fused. The separator extends across a path of the recording medium so that a predetermined amount of gap is defined between the separator and the fixing roller. The separator guides the recording medium to separate from the fixing roller. The spacers are disposed at longitudinal end portions of the separator outside of the path between the fixing roller and the separator to define the predetermined amount of gap. The spacers are movable in a direction at an angle with a surface of the recording medium. The urging member urges the spacers against the fixing roller.

35 Claims, 24 Drawing Sheets

65
UPWARD
DOWNWARD 51
69
INCLINE
62
21

62

IMAGE FORMING APPARATUS WITH PAPER SEPARATOR-FIXING ROLLER GAP MECHANISM

BACKGROUND OF THE INVENTION

1. Field of the Invention

The present invention generally relates to a fixing apparatus and an image-forming apparatus that incorporates the fixing apparatus.

2. Description of the Related Art

A conventional electrophotographic image-forming apparatus uses a fixing unit that includes upper and lower rollers and separators. The upper and lower rollers abut each other with a predetermined nip formed between them, and rotate while being heated. The separators separate a fixed recording medium from the upper and lower rollers to prevent the recording medium from becoming tacked to the upper and roller rollers.

The separators are disposed in such a way that a predetermined gap is created between the separator and a corresponding roller. The separator includes a plurality of tongues and spacers. The tongues are mounted on, for example, a mounting board and aligned in a longitudinal direction to act directly on the recording medium to detack the recording medium from the roller. The spacers are in pressure contact with the roller and maintain a predetermined gap between the roller and the tongues. The separator is rotatable about an axis parallel to a rotational shaft of the roller and is urged against the roller. As a result, even when the roller changes in diameter due to thermal expansion, the separator maintains the gap.

A problem with the aforementioned conventional fixing unit is that the recording medium may be caught by some of the tongues to become jammed. When the roller changes in diameter at its longitudinal end portions due to thermal expansion, the spacer at one end portions moves out of contact with the roller, failing to maintain the predetermined gap between the tongues and the roller across the length of the roller.

SUMMARY OF THE INVENTION

An object of the invention is to solve the aforementioned problems with the conventional fixing unit.

An object of the invention is to provide a fixing apparatus and an image-forming apparatus that incorporates the fixing apparatus, the fixing apparatus including spacers pressed against a roller (or, fixing roller or fixing member) to maintain a gap between a separator and the roller even when the diameter of the roller changes due to thermal expansion.

A fixing apparatus comprising:

a fixing member (i.e., the fixing roller) that is heated while rotating, the fixing member being in pressure contact with a recording medium that is advancing so that the developer deposited on the recording medium is fused;

a guiding member (or, separator) extending across a path of the recording medium so that a predetermined amount of gap is defined between the guiding member and the fixing member (fixing roller), the guiding member guiding the recording medium to separate from the fixing member;

spacers disposed at longitudinal end portions of the guiding member outside of the path, the spacers being between the fixing member and the guiding member to define the predetermined amount of gap, spacers being movable in directions at an angle with a surface of the recording medium; and an urging member that urges the spacers against the fixing member.

The fixing member rotates about a first axis and the spacers are rotatable about a second axis substantially parallel to the first axis.

The spacers are rotatable about the second axis independently.

The guiding member is resilient.

The guiding member and the spacers are coupled in such a way that the guiding member is movable relative to the spacers.

The guiding member engages the spacers resiliently.

The fixing apparatus further includes an adjustment member (or, adjustment mechanism) that adjusts a positional relation between the guiding member and the spacers.

The guiding member is shaped to define a larger gap at the middle portion of the guiding member than at the longitudinal end portions of the guiding member.

The fixing apparatus further includes an inclination adjustment mechanism that adjusts an inclination of the guiding member relative to the fixing member, i.e., a device capable of adjusting the angle of the separator in relation to the fixing roller.

The inclination adjustment mechanism operates to incline the guiding member while also maintaining the predetermined gap between the guiding and the fixing member.

A fixing apparatus includes:

a fixing member that is heated and is rotating about a first axis, the fixing member being in pressure contact with an advancing recording medium in such a way that the developer deposited on the recording medium is fused;

a guiding member that defines a predetermined amount of gap between the guiding member and the fixing member, the guiding member guiding the recording medium to separate from the fixing member;

spacers disposed at longitudinal end portions of the guiding member outside of the path, the spacers being disposed between the fixing member and the guiding member to define the predetermined amount of gap, wherein the spacers are rotatable independently about a second axis substantially parallel to the first axis so that the spacers are movable in directions at an angle with a surface of the recording medium; and an urging member that urges the spacers against the fixing member.

The fixing apparatus further includes an adjustment mechanism that adjusts a positional relation between the guiding member and the spacers.

The fixing apparatus further includes an inclination adjustment mechanism that adjusts an inclination of the guiding member relative to the fixing member, i.e., a device capable of adjusting the angle of the separator in relation to the fixing roller.

The inclination adjustment mechanism operates to incline the guiding member while also maintaining the predetermined gap between the guiding and the fixing member.

An image-forming apparatus incorporates the aforementioned fixing apparatus and an image-forming section that forms an image with a developer on a recording medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 6A being a left side view, FIG. 6B being a front view, and FIG. 6C being a right side view;

DETAILED DESCRIPTION OF THE INVENTION

First Embodiment

{Construction}

Embodiments of the invention will be described in detail with reference to the drawings.

Figure 1:
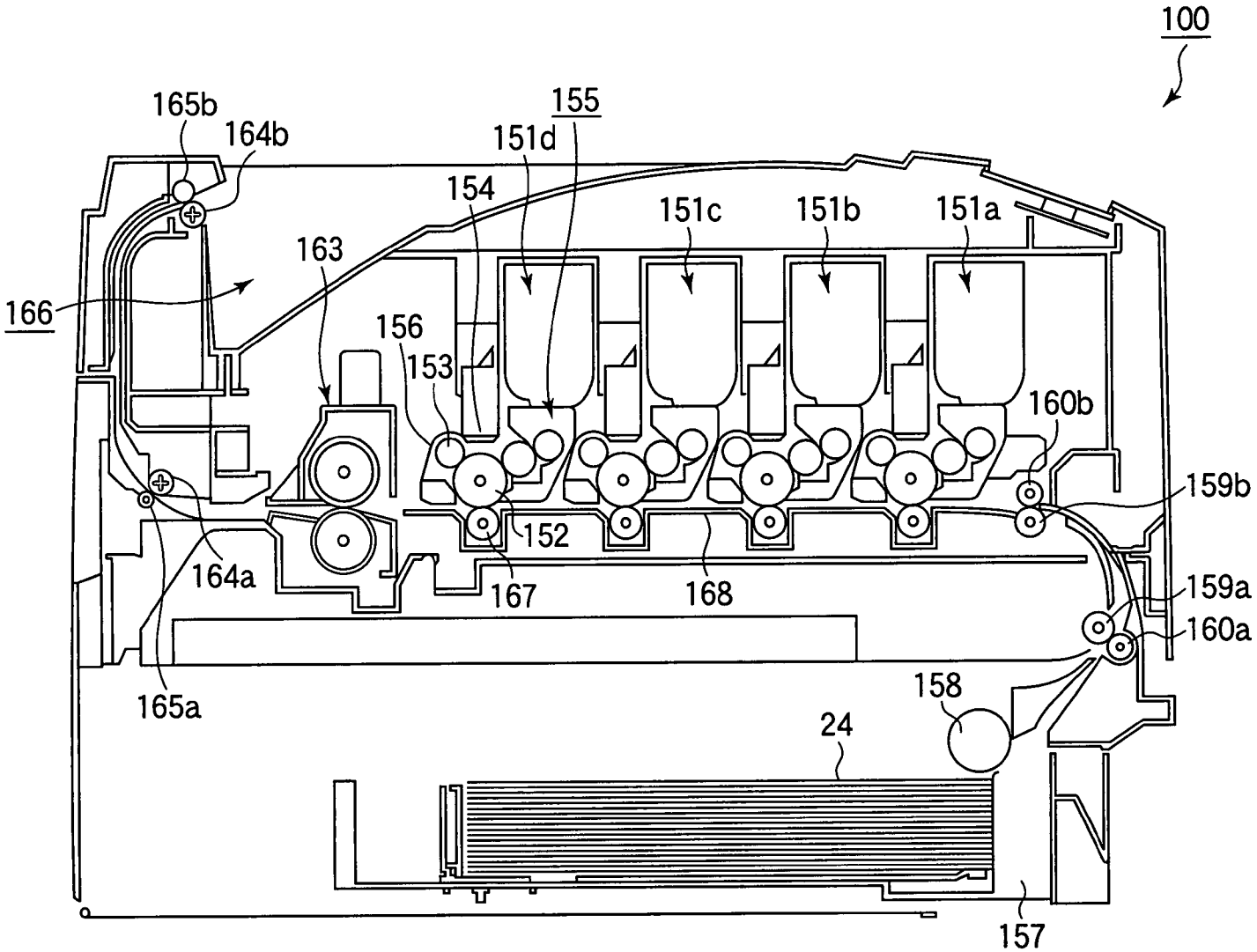
FIG. 1 is a schematic view illustrating an image-forming apparatus according to a first embodiment.

FIG. 1 is a schematic view illustrating an image-forming apparatus according to a first embodiment.

Referring to FIG. 1, an image-forming apparatus 100 is a composite apparatus of any type that performs functions of an electrophotographic printer, a facsimile machine, a copier, and a fax-and-copier. The present invention will be described with respect to a case in which the image-forming apparatus 100 is a color electrophotographic printer.

There are four process units 151*a*–151*d* in tandem for forming yellow, magenta, cyan, and black images, respectively. The process units 151*a*–151*d* are aligned along a transport path in which a recording medium 24 is transported. Each of the process units 151*a*–151*d* includes a photoconductive drum 152, a charging unit 153, and an exposing unit 154. The charging unit 153 and exposing unit 154 are disposed around the photoconductive drum 152. The charging unit 153 charges the surface of the photoconductive drum 152, and the exposing unit 154 selectively illuminates the charged surface of the photoconductive drum 152 to form an electrostatic latent image on the photoconductive drum 152.

A developing unit 155 and a cleaning unit 156 are also disposed around the photoconductive drum 152. The developing unit 155 applies toner to the electrostatic latent image formed on the photoconductive drum 152. The cleaning unit 156 removes residual toner from the surface of the photoconductive drum 152. The photoconductive drum 152 is driven in rotation by means of gears and a drive source, not shown.

A paper cassette 157 holds a stack of the recording medium 24 such as paper. A hopping roller 158 is disposed over the paper cassette 157 and feeds the recording medium 24 from the paper cassette 157 on a sheet-by-sheet basis. Registry rollers 159*a* and 159*b* are disposed downstream of the hopping roller 158 with respect to a direction of travel of the recording medium 24. The registry rollers 159*a* and 159*b* cooperate with pinch rollers 160*a* and 160*b*, respectively, to hold the recording medium 24 therebetween in a sandwiched relation, thereby advancing the recording medium 24 with a least amount of skew.

The recording medium 24 is advanced until a part of the leading edge of the recording medium 24 abuts the registry roller 159*b* at rest, and then advanced little further so that the entire leading edge abuts the registry rollers 159*a* and 159*b*.

In this manner, the hopping roller 158 and registry rollers 159*a* and 159*b* are operatively driven in rotation by a drive source, not shown.

A transfer roller 167 opposes the photoconductive drum 152 and is formed of a semiconductive rubber material. The transfer roller 167 and photoconductive drum 152 receives different bias voltages, so that the potential difference between the photoconductive drum 152 and the transfer roller 167 causes the toner on the photoconductive drum 152 to be transferred onto the recording medium 24.

A fixing unit 163 includes a heat roller and a backup roller by which the toner image on the recording medium 24 is fused by heat and under pressure. Discharge rollers 164*a* and 164*b* are driven in rotation by a drive source, not shown, and cooperate with the pinch rollers 165*a* and 165*b*, respectively, to transport the recording medium 24 in a sandwiched relation.

{Operation of the Image-Forming Apparatus}

The operation of the aforementioned image-forming apparatus 100 will be described.

A stack of the recording medium 24 is held in the paper cassette 157 and the hopping roller 158 feeds the recording medium 24 from the paper cassette 157 to the transport path on a sheet-by-sheet basis. The recording medium 24 is then held between the registry rollers 159*a* and 159*b* and pinch rollers 160*a* and 160*b* in a sandwiched relation and transported to a transfer point defined between the photoconductive drum 152 and the transfer roller 167 of the process unit 151*a*. Thereafter, the recording medium 24 held between the photoconductive drum 152 and the transfer roller 167 is advanced as the photoconductive drum 152 rotates.

Subsequently, the recording medium 24 passes through the process units 151*b*, 151*c*, and 151*d*, so that the toner images of corresponding colors are transferred onto the corresponding medium 24 in registration.

The toner images of the respective colors transferred onto the recording medium 24 in registration are fused into a permanent image in the fixing unit 163. Then, the recording medium 24 is further transported while being held between the discharge rollers 164*a* and 164*b* in a sandwiched relation. The recording medium 24 is finally discharged to a stacker 166 located outside of the image-forming apparatus 100. In this manner, a color image is formed on the recording medium 24 without color shift.

{Fixing Unit}

The fixing unit 163 will be described.

Figure 2:
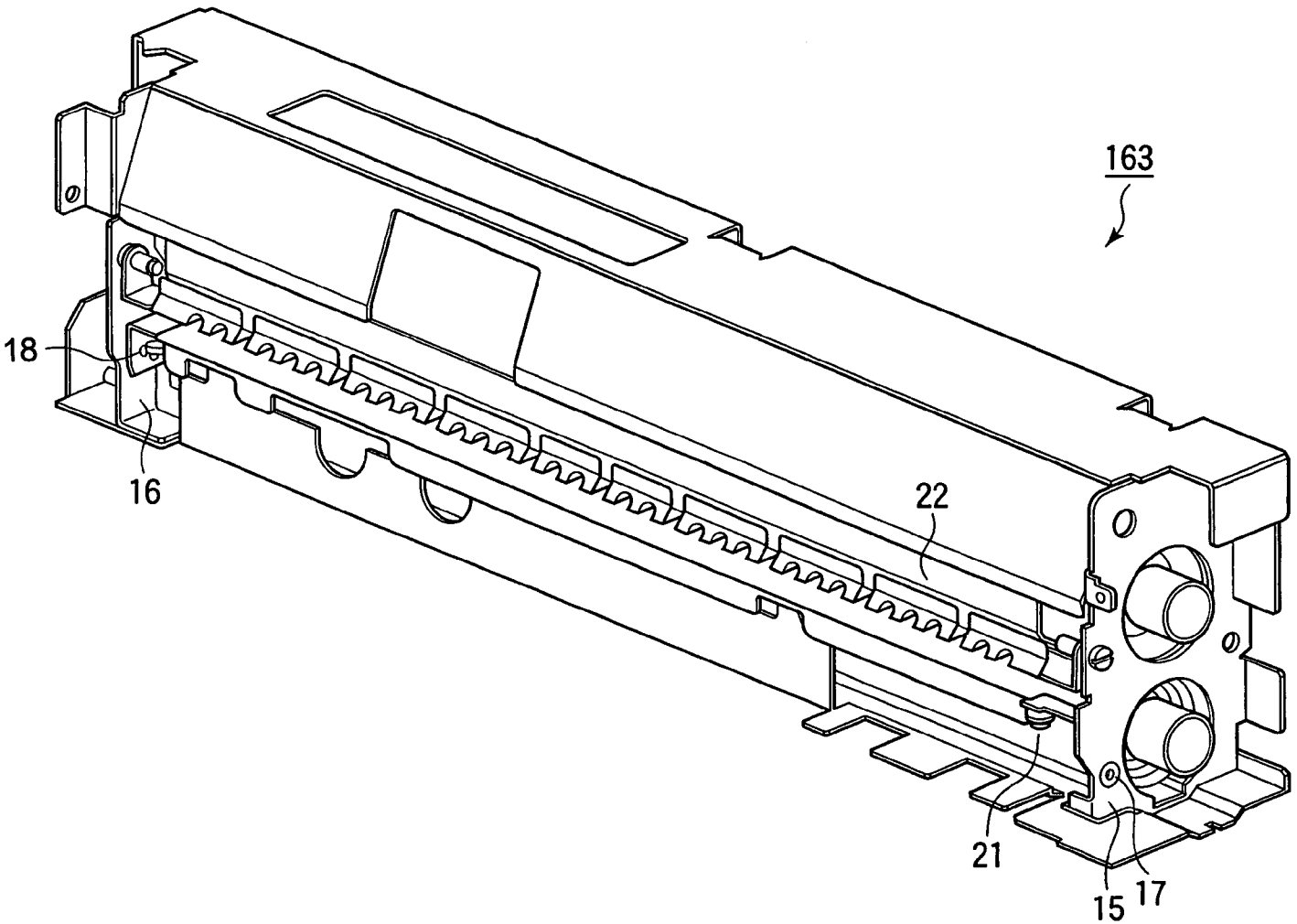
FIG. 2 is a perspective view of a fixing unit according to the first embodiment.

FIG. 2 is a perspective view of the fixing unit 163.

Figure 3:
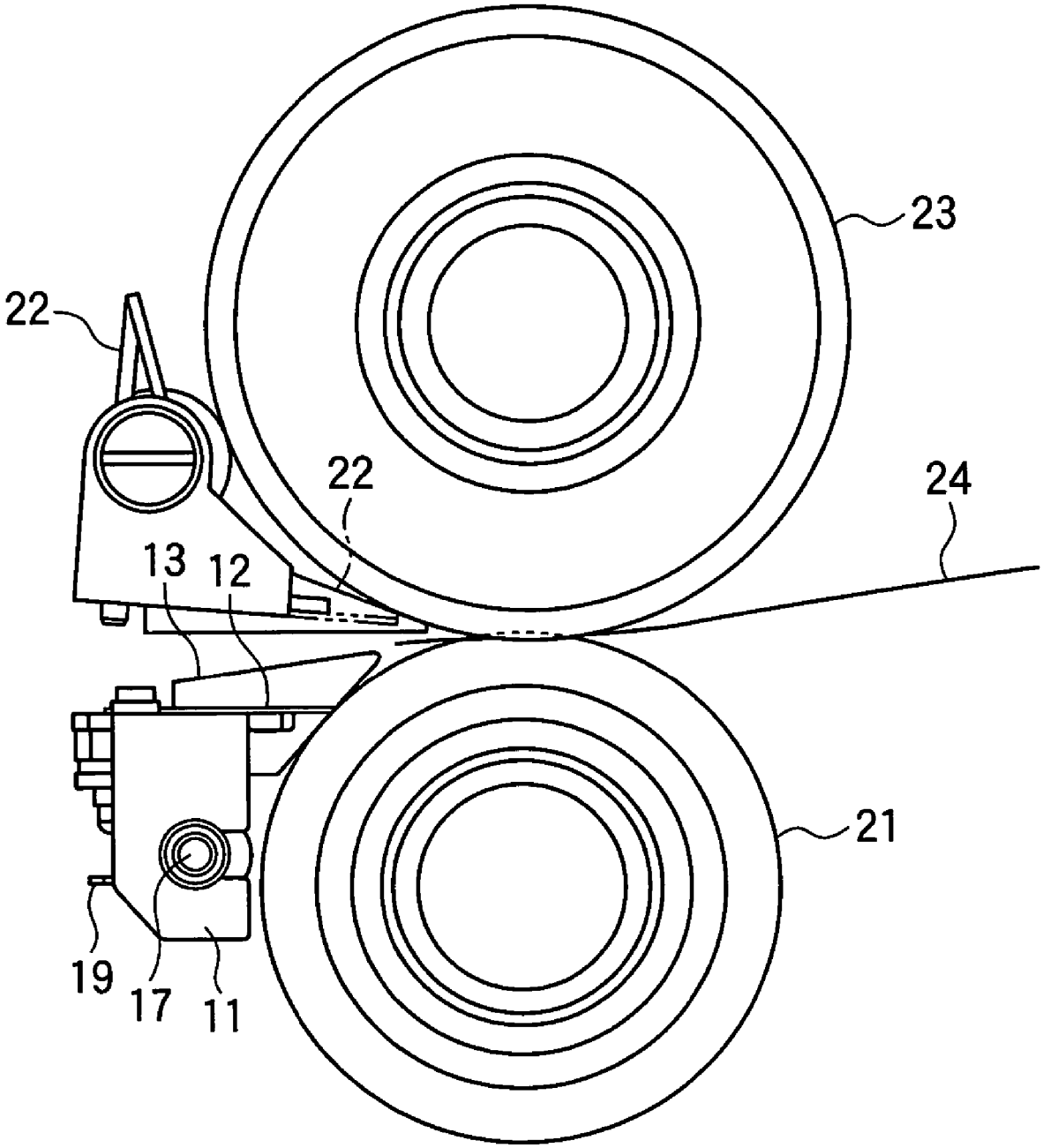
FIG. 3 is a side view of the fixing unit according to the first embodiment.

FIG. 3 is a side view of the fixing unit 163.

In FIG. 3, reference numerals 23 and 24 denote the upper roller and recording medium, respectively.

Figure 4A:
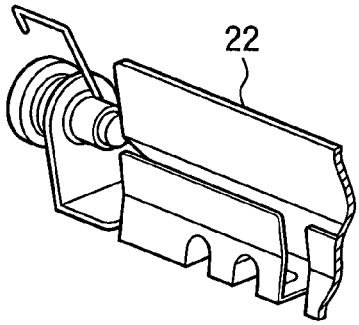
FIGS. 4A–4B are perspective views of an upper separator.
Figure 4B:
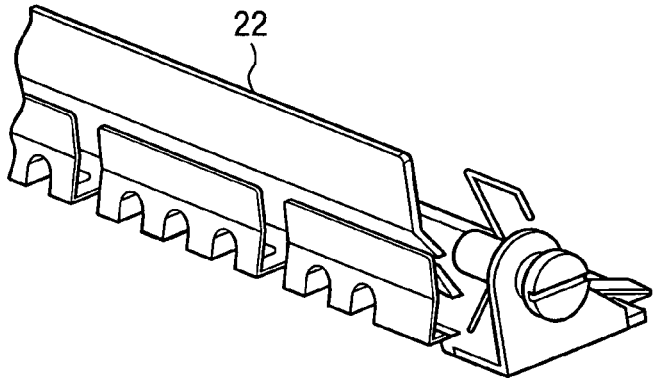

FIGS. 4A and 4B are perspective views of an upper separator 22.

Figure 5A:
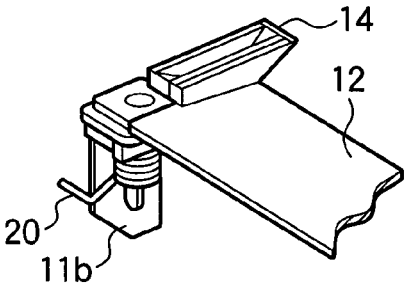
FIGS. 5A–5B are perspective views of a lower separator.
Figure 5B:
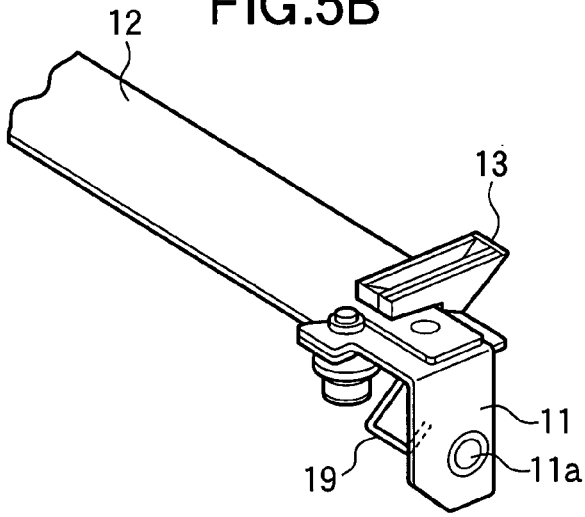

FIGS. 5A and 5B are perspective views of a lower separator 12.

Referring to FIG. 5A, a holder 11 and the lower separator 12 are securely assembled in an integral assembly. Lower spacers 13 and 14 are firmly fixed to left and right end portions of the lower separator 12. The holder 11 has fulcrum holes 11*a* and 11*b* formed therein, which receive posts 17 and 18 provided on side plates 15 and 16 (FIG. 2), respectively. The torsion springs 19 and 20 urge the lower spacers 13 and 14 against a lower roller 21 that operates as a fixing means (FIG. 3). The upper separator 22 is of similar configuration to the lower separator 12.

The lower separator 12 and upper separator 22 in the embodiment are in the shape of a thin rectangular plate of SUS (stainless steel) Alternatively, the lower separator 12 and upper separator 22 may be a thin plate of metal such as phosphor bronze or any other metal materials providing that the material has resiliency. The lower separator 12 and lower spacers 13 and 14 may be secured together by a bonding agent, bolting, or fitting.

The size of gaps between the upper separator 22 and upper roller 23 and between the lower separator 12 and lower roller 21 are selected based on test results when continuous printing of 10 pages of 240% solid images was performed in a high-temperature and high-humidity environment (30° C., 80%) on thin paper having a top margin of 3.75 mm. The gap between the upper separator 22 and upper roller 23 is selected to be 0.37±0.06 mm. The gap between the lower separator 12 and lower roller 21 is selected to be 0.21±0.07 mm. The gap may be changed according to the printing conditions.

{Operation of Fixing Unit}

The operation of the fixing unit 163 of the aforementioned configuration will be described.

When the image-forming apparatus 100 is powered on and a printing operation is initiated, the recording medium 24 is advanced to the fixing unit 163. If the recording medium 24 is about to become tacked to the upper roller 23, the upper separator 22 separates the recording medium 24 from the upper roller 23. If the recording medium 24 is about to become tacked to the lower roller 21, the lower separator 12 separates the recording medium 24 from the lower roller 21. In other words, the upper and lower separators 22 and 12 serve as a guiding member that guides the recording medium 24 to smoothly pass through the fixing unit 163 without becoming tacked to the upper and lower rollers 23 and 21.

The thermal expansion of the lower roller 21 causes the lower spacers 13 and 14 to rotate about the posts 17 and 18, so that the spacers are movable substantially in directions at an angle with a surface of the recording medium 24 or a direction of travel of the recording medium 24. Because the lower spacers 13 and 14 are fixed to the lower separator 12, the lower separator 12 is twisted but a predetermined amount of gap is maintained between the lower roller 21 and the lower separator 12. The top margin portion of the recording medium 24, which is usually difficult to become tacked to the lower roller 21, is guided by the lower separator 12 to separate from the lower roller 21.

Figure 6C:
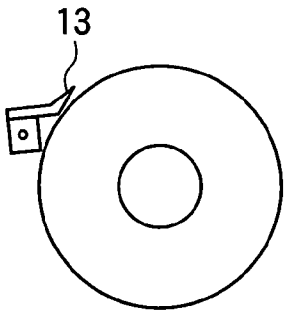
FIGS. 6A–6C illustrate the lower separator when it is twisted.
Figure 6B:
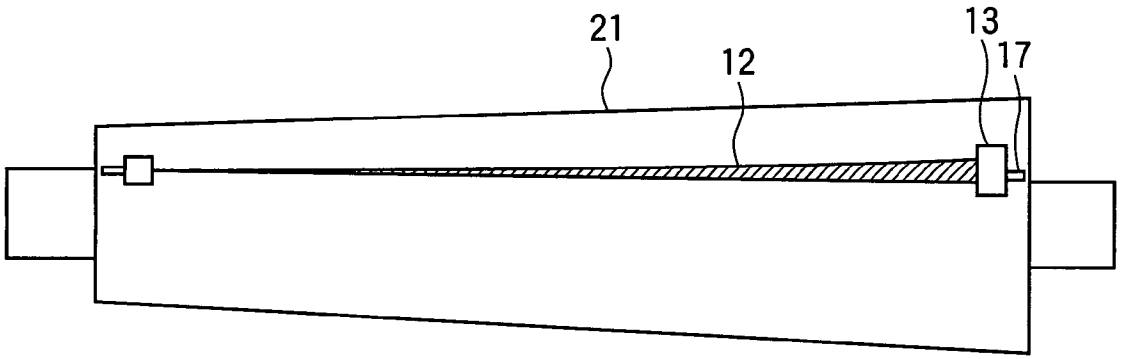
Figure 6A:
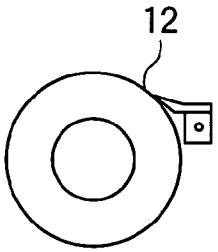

FIGS. 6A–6C illustrate the lower separator 12 when it is twisted, FIG. 6A being a left side view, FIG. 6B being a front view, and FIG. 6C being a right side view.

Because the lower spacers 13 and 14 and the lower separator 12 are secured together, even if the longitudinal end portions of the lower roller 21 have different diameters due to different amounts of thermal expansion, the twisted lower separator 12 still maintains the same gap between the lower roller 21 and the lower separator 12. This is true for the gap between the upper separator 22 and the upper roller 23.

In the first embodiment, a means is provided for pressing the lower spacers 13 and 14 against the lower roller 21 and the lower spacers 13 and 14 are secured to the lower separator 12, thereby maintaining a predetermined gap between the lower roller 21 and the lower separator 12. When the diameter of the lower roller 21 changes due to thermal expansion, the lower spacers 13 and 14 rotate slightly about the posts 17 and 18 correspondingly. As a result, the lower separator 12 is twisted while also yielding a stable amount of gap to ensure the separation of the recording medium 24 from the lower roller 21. The upper separator 22 is of the same configuration as the lower separator 12, so that the gap between the upper separator 22 and the upper roller 23 is maintained constant likewise.

The first embodiment may be applicable not only to a fixing unit incorporating rollers but to a fixing unit incorporating a fixing belt.

Second Embodiment

Elements of the same structure as those in the first embodiment have been given the same reference numerals and the description thereof is omitted. A description is also omitted of the same operations and advantages as the first embodiment.

The second embodiment reduces twisting of an upper separator 111 and lower separator 121 that would otherwise occur due to the thermal expansion of the upper roller 23 and lower roller 21, and twisting and variations of dimensions of structural members such as the frames of the fixing unit 163.

Figure 7:
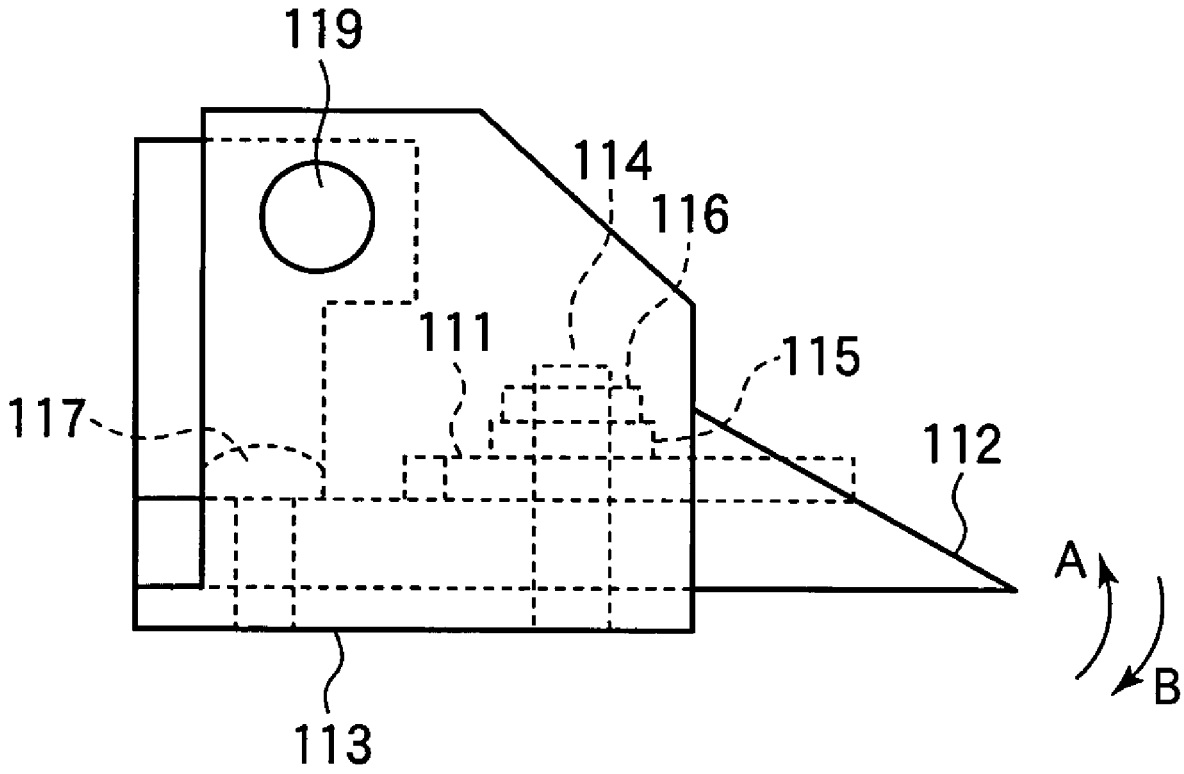
FIG. 7 is a side view of an upper spacer and an upper separator according to a second embodiment.

FIG. 7 is a side view of an upper spacer 112 and the upper separator 111 assembled together.

Figure 8:
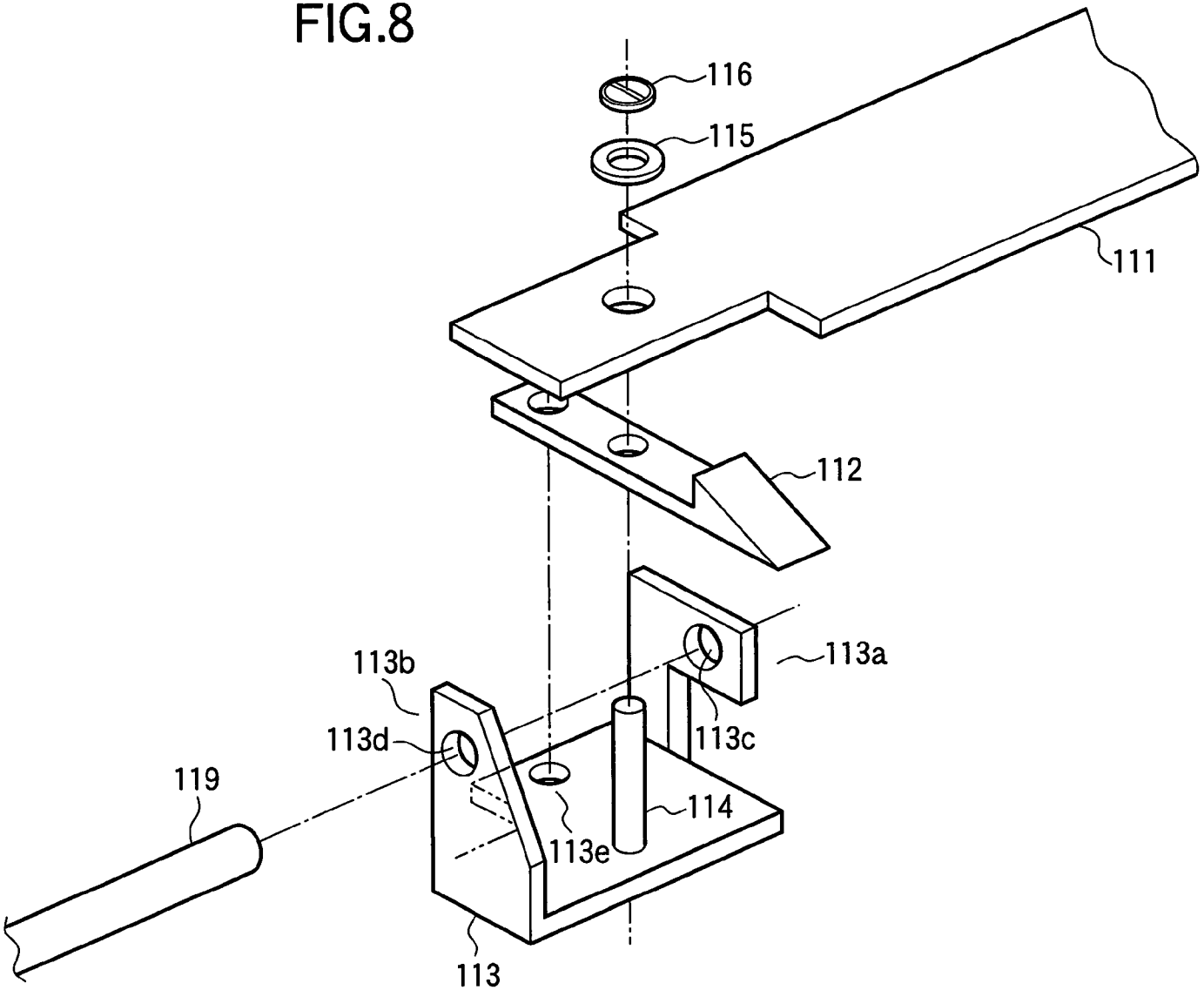
FIG. 8 is an exploded perspective view illustrating the upper spacer and upper separator of FIG. 7.

FIG. 8 is an exploded perspective view illustrating the upper spacer 112 and upper separator 111 of FIG. 7.

As shown in FIGS. 7 and 8, a holder 113 is a metal plate into which the post 114 is fitted tightly. The upper separator 111 has holes 111*a* formed in its longitudinal end portions, the holes 111*a* receiving posts 114 of the holder 113 for securing the upper spacer 112. Only one of the holes 111*a* is shown. The upper spacer 112 fastened to the holder 113 by means of a bolt 117 inserted into a threaded hole 113*e*.

The upper separator 111 is placed on the upper spacer 112 bolted to the holder 113 and washers 115 and E rings 116 are mounted to the posts 114, so that the upper separator 111 will not disengage from the post 114 but is allowed to slightly move along the length of the post 114 and in directions shown by arrows A and B. The same structure as that in FIG. 8 is provided on the other end of the upper separator 111.

The mounting construction of a lower spacer 122 and a lower separator 121 will be described.

Figure 9:
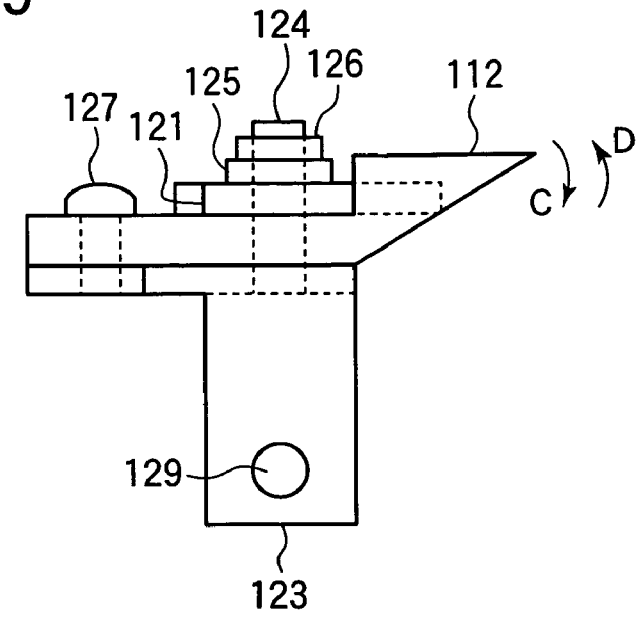
FIG. 9 is a side view illustrating a lower spacer and a lower separator according to the second embodiment.

FIG. 9 is a side view illustrating the lower spacer 122 and lower separator 121.

Figure 10:
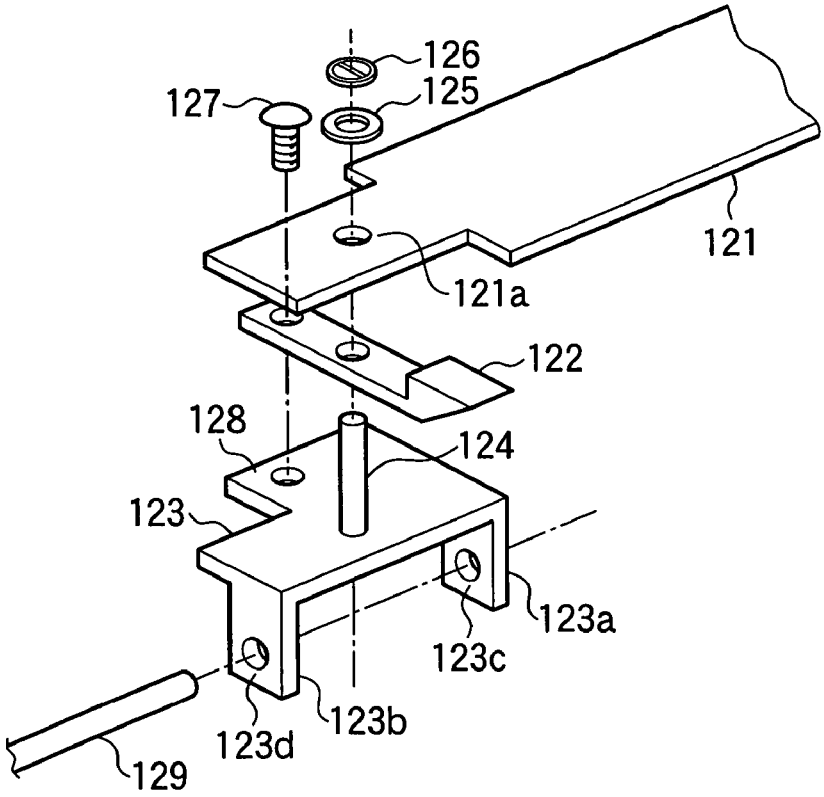
FIG. 10 is an exploded perspective view illustrating how the lower spacer and lower separator are assembled.

FIG. 10 is an exploded perspective view illustrating the lower spacer 122 and lower separator 121.

Referring to FIGS. 9 and 10, the holder 123 is formed of a metal plate and a post 124 is firmly fitted into the holder 123. The lower separator 121 has a hole 121*a* formed in its each longitudinal end portion, into which the post 124 of the holder 123 extends through the lower spacer 122. The lower spacer 122 is fastened to the holder 123 by means of a screw 127 inserted into a threaded hole 128.

The lower separator 121 is placed on the lower spacer 122 screwed to the holder 123 and a washer 125 and an E ring 126 are mounted to the post 124, so that the lower separator 121 will not disengage from the post 124. The E ring 126 prevents the lower separator 121 and lower spacer 122 from disengaging from the post 124 but allows slight movement of the lower separator 121 relative to the lower spacer 122 along the length of the post 114 in a direction shown by arrows C and D in FIG. 9. The same structure as that in FIG. 9 is provided on the other end of the lower separator 121.

The holders 113 are generally U-shaped with opposing side portions 113*a* and 113*b* extending in parallel. The opposed side portions 113*a* and 113*b* have holes 113*c* and 113*d*, respectively, through which a shaft 119 extends.

The holders 123 are generally U-shaped with opposing side portions 123*a* and 123*b* extending in parallel. The opposed side portions 123*a* and 123*b* have holes 123*c* and 123*d*, respectively, through which a shaft 129 extends. The shafts 119 and 129 are parallel to the upper roller 23 and lower roller 21, respectively, so that the upper separator 111 is parallel to the upper roller 23 and the lower separator 21 is parallel to the lower roller 21.

The operation of the fixing unit 163 of the aforementioned configuration will be described.

The holder 113 assembled to one longitudinal end of the upper separator 111 and another holder assembled to the other longitudinal end are urged by torsion springs, not shown, to rotate about the shaft 119 toward the upper roller 23. As a result, the upper spacers 112 (only one of which is shown in FIG. 8) that are fixed on the holder 113 are urged against the upper roller 23 under a predetermined pressure and movable in directions at an angle with the surface of the recording medium 24 or a direction of travel of the recording medium 24.

The holder 123 assembled to one longitudinal end portion of the lower separator 121 and another holder (not shown) assembled to the other longitudinal end portion are urged by torsion springs, not shown, to rotate about the shaft 129 toward the lower roller 21. As a result, the lower spacers 122 that are fixed on the holder 123 and another holder are urged against the lower roller 21 under a predetermined pressure and movable in directions at an angle with the surface of the recording medium 24 or a direction of travel of the recording medium 24.

The lower spacer 122 and upper spacer 112 rotate about the shafts 129 and 119, respectively, and are urged against the lower roller 21 and upper roller 23, respectively. Thus, as long as the shafts 119 and 129 are parallel to the upper roller 23 and lower roller 21, respectively, a uniform amount of gap between the lower roller 21 and lower separator 121 should be maintained across the lower separator 121, and a uniform amount of gap between the upper roller 23 and upper separator 111 should be maintained across upper separator 111.

However, if the lower spacers 122 are to be mounted firmly on the left and right longitudinal ends of the lower separator 121, then the lower spacers 122 cannot be in even contact with the lower roller 21 when the fixing unit 163 is twisted or the lower separator 121 is assembled with very small dimensional errors. In other words, the gap between the lower separator 121 and the lower roller 21 is either larger or smaller at one longitudinal end of the lower roller 23 than at the other.

Likewise, if the upper spacers 112 are to be mounted firmly on the left and right longitudinal end portions of the upper separator 111, then the upper spacers 112 cannot be in even contact with the upper roller 23 when the fixing unit 163 is twisted or the upper separator 111 are assembled with very small dimensional errors.

In other words, the gap between the upper separator 111 and the upper roller 23 is either larger or smaller at one longitudinal end of the upper roller 23 than at the other.

The upper spacer 112 is adapted to move relative to the upper separator 111 in a direction shown by arrows A and B in FIG. 7. Another spacer, not shown, mounted at another longitudinal end of the upper separator 121 is adapted to move in the same manner as the upper spacer 112 in FIG. 7. This configuration allows setting of the gaps between the upper roller 23 and upper separator 111 at both longitudinal end portions of the upper roller 23 irrespective of the torsional deformation of the fixing unit 163.

The lower spacer 122 is adapted to move relative to the lower separator 121 in a direction shown by arrows C and D in FIG. 9. Another spacer, not shown, mounted at another longitudinal end of upper separator 121 is adapted to move in the same manner as the lower separator 122 in FIG. 9. This configuration allows setting of the gaps between the lower roller 21 and lower separator 121 at both longitudinal end portions of the lower roller 21 irrespective of the torsional deformation of the fixing unit 163.

In the present embodiment, the upper and lower spacers 112 and 122 are mounted to the upper and lower separators 111 and 121, respectively, in such a way that the upper and lower spacers 112 and 122 are movable relative to the upper and lower separators 111 and 121, respectively. Thus, even when the fixing unit 163 is twisted, the uniform gaps can be maintained between the upper roller 23 and separator 111 across the length of the upper roller 23 and between the lower roller 21 and lower separator 121 across the length of the lower roller 21. Thus, even when the image-forming apparatus 100 operates at a high speed, the fixing unit 163 will not lose the ability to prevent the recording medium 24 from becoming tacked to the upper roller 23 and lower roller 21.

Third Embodiment

Elements similar to those in the first and second embodiments have been given the same reference numerals and the description thereof is omitted.

Figure 11:
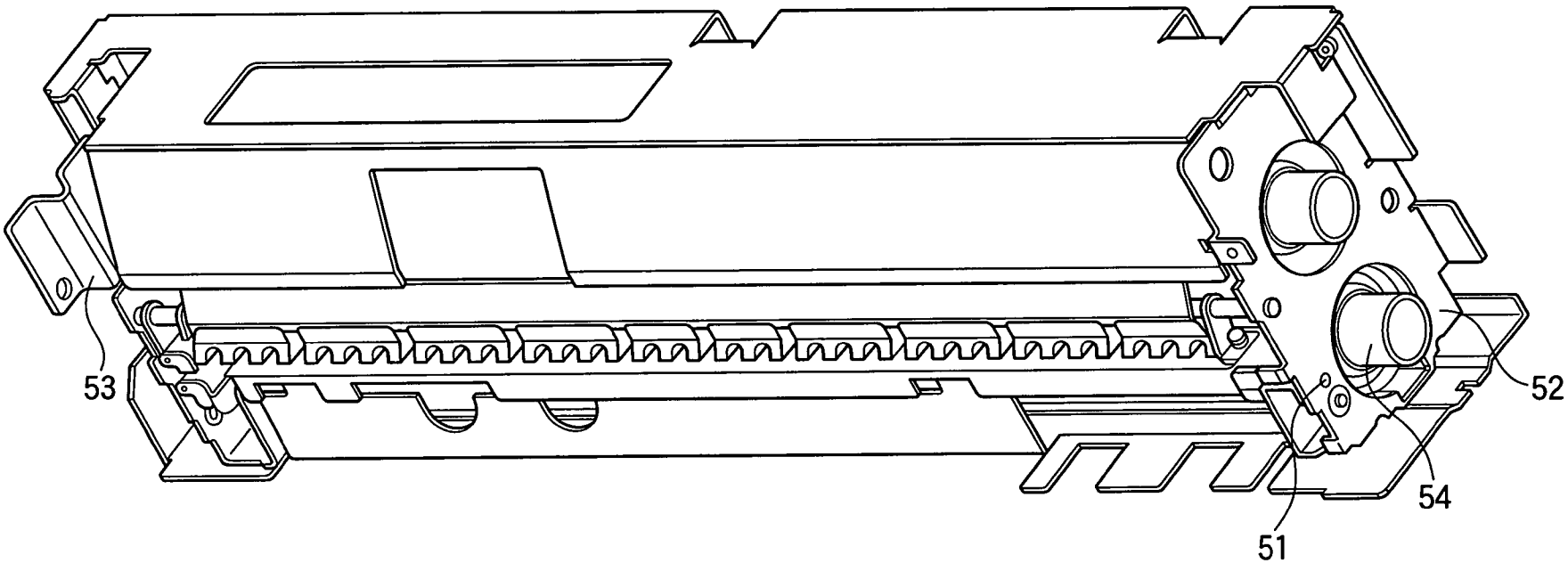
FIG. 11 is a perspective view of a fixing unit according to a third embodiment.

FIG. 11 is a perspective view of a fixing unit according to a third embodiment.

Figure 12:
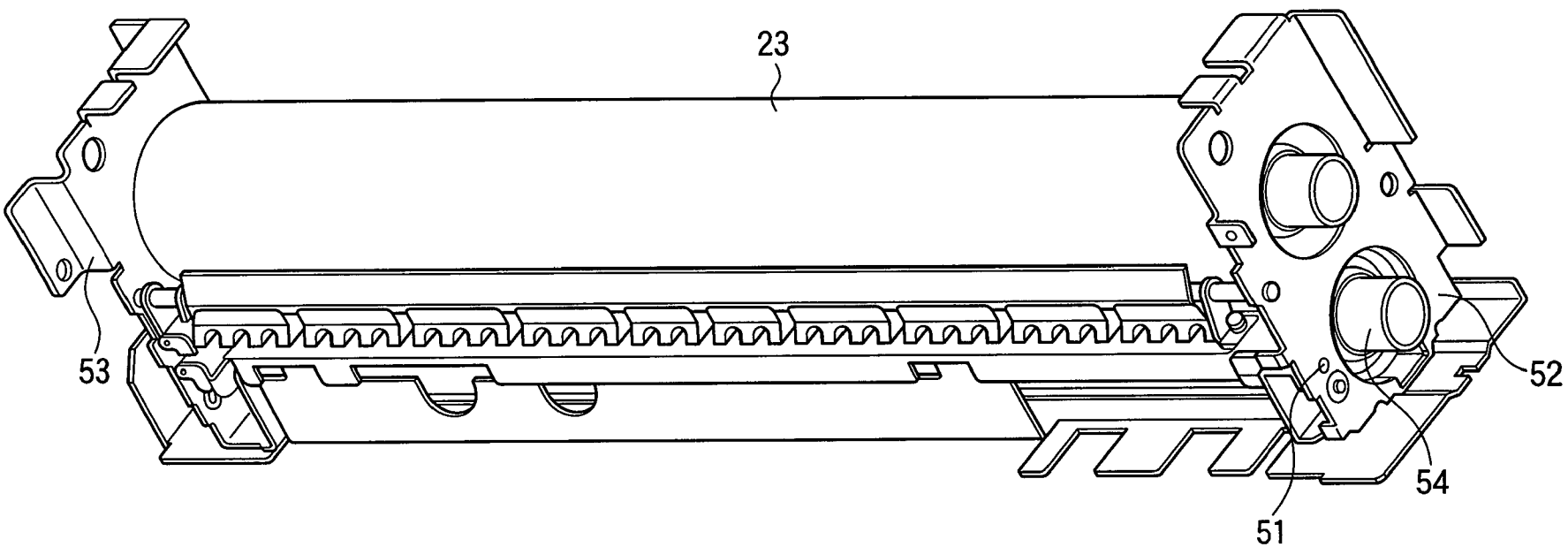
FIG. 12 is a perspective view of the fixing unit of FIG. 11 when a top plate is removed.

FIG. 12 is a perspective view of the fixing unit of FIG. 11 when a top plate is removed.

Figure 13:
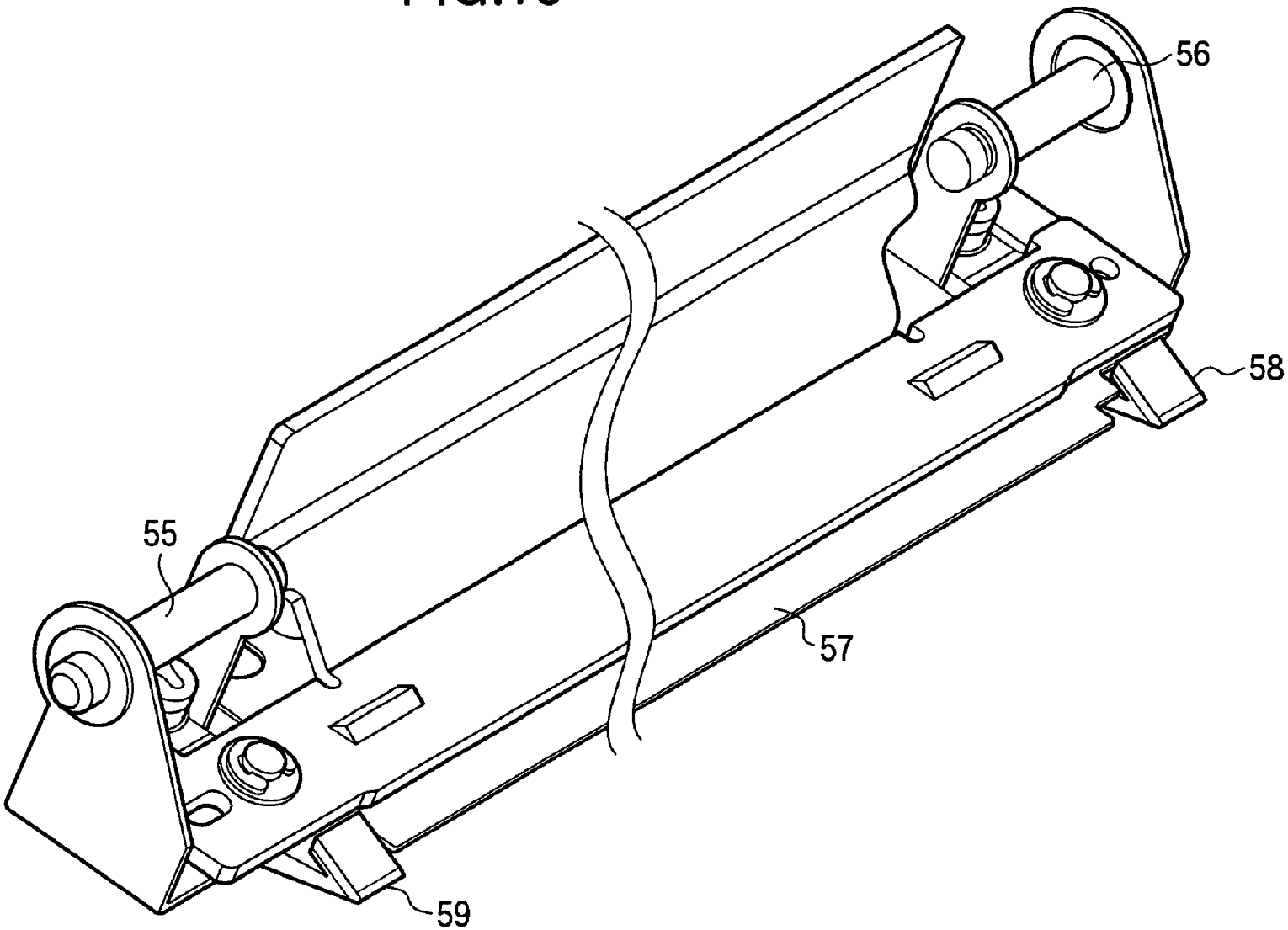
FIG. 13 is a perspective view of a pertinent portion of an upper separator of FIG. 11.

FIG. 13 is a perspective view of a pertinent portion of an upper separator 57.

Figure 14A:
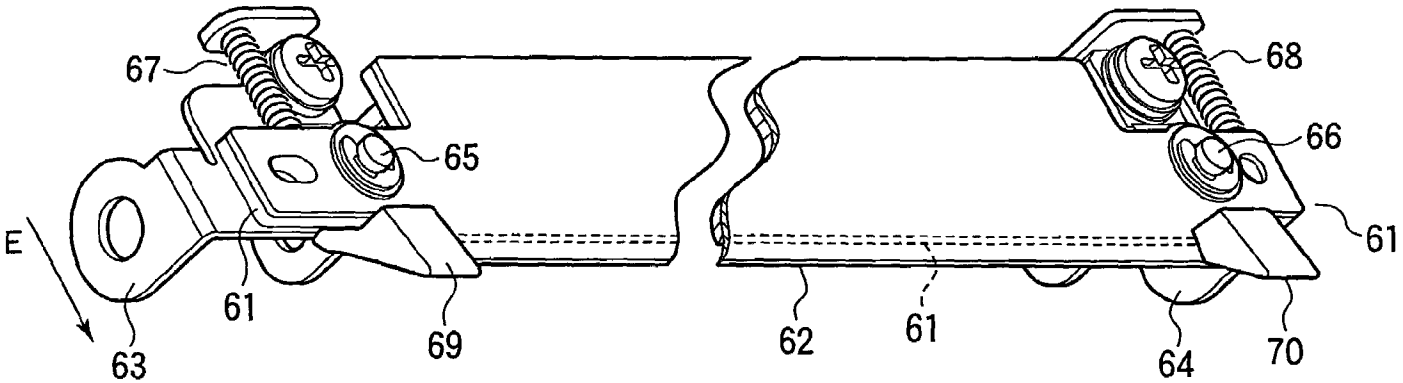
FIG. 14A is a perspective view of a pertinent portion of a lower separator according to the third embodiment.

FIG. 14A is a perspective view of a pertinent portion of a lower separator 62.

Figure 14B:
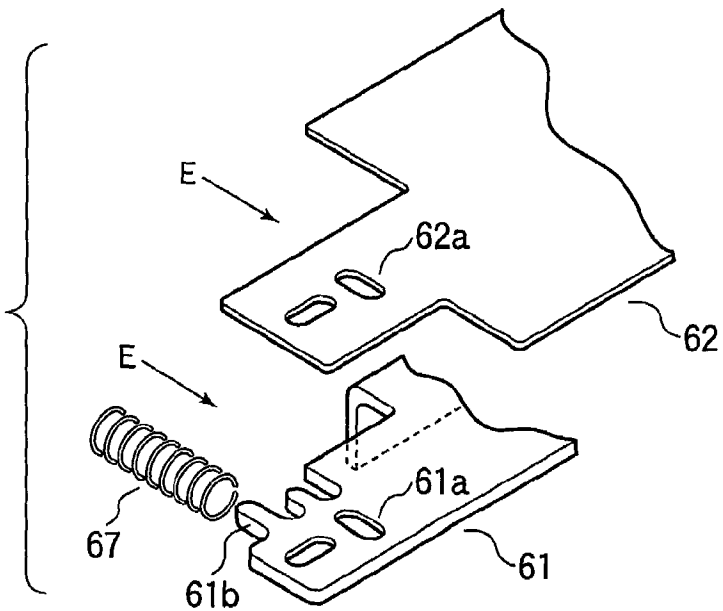
FIG. 14B is an exploded perspective view of a pertinent portion of the lower separator of FIG. 14A.

FIG. 14B is an exploded perspective view of a pertinent portion of the lower separator 62.

Figure 15:
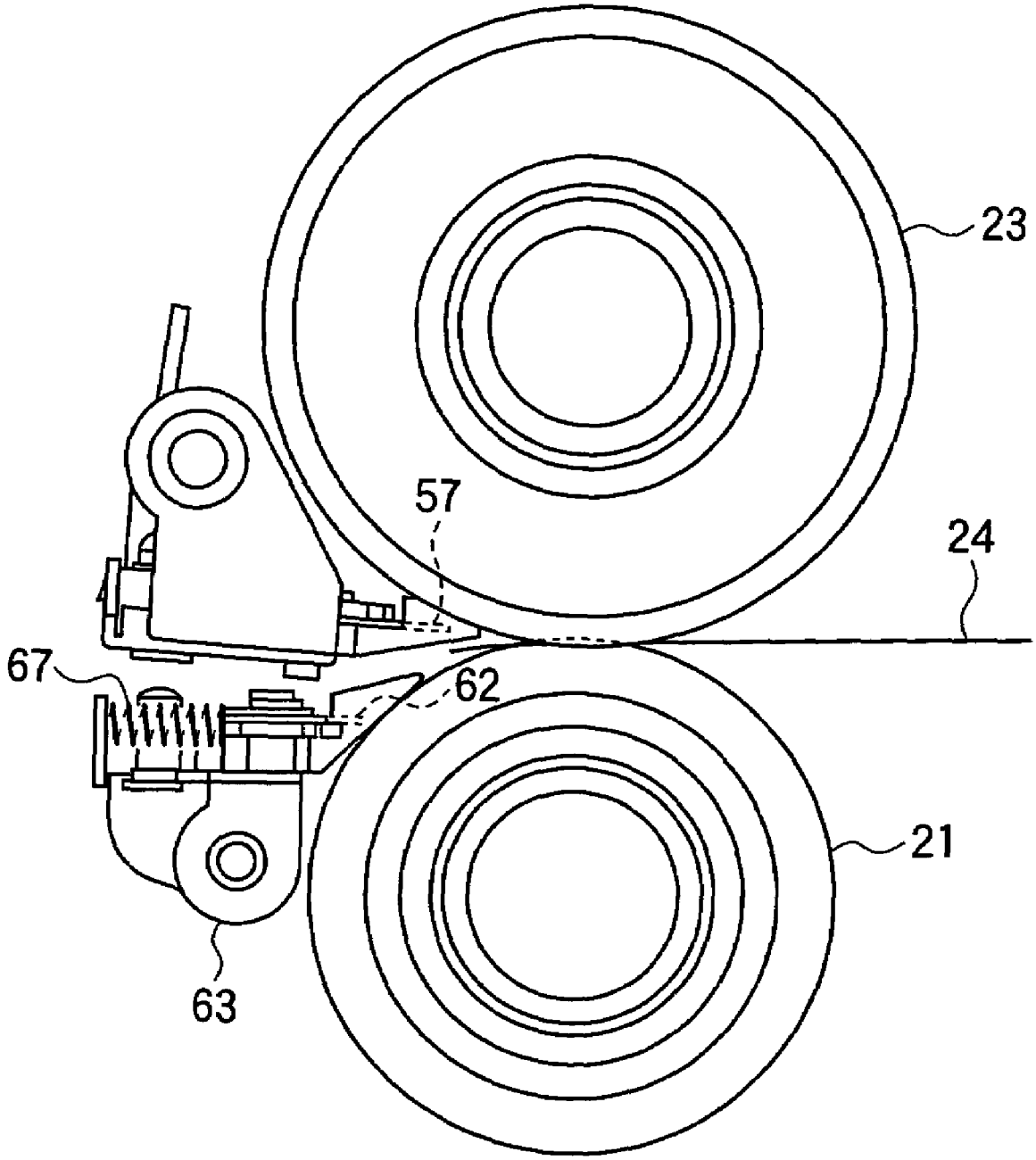
FIG. 15 is across-sectional side view of the fixing unit according to the third embodiment.

FIG. 15 is a cross-sectional side view of the fixing unit.

Figures 16A, 16B, 16C:
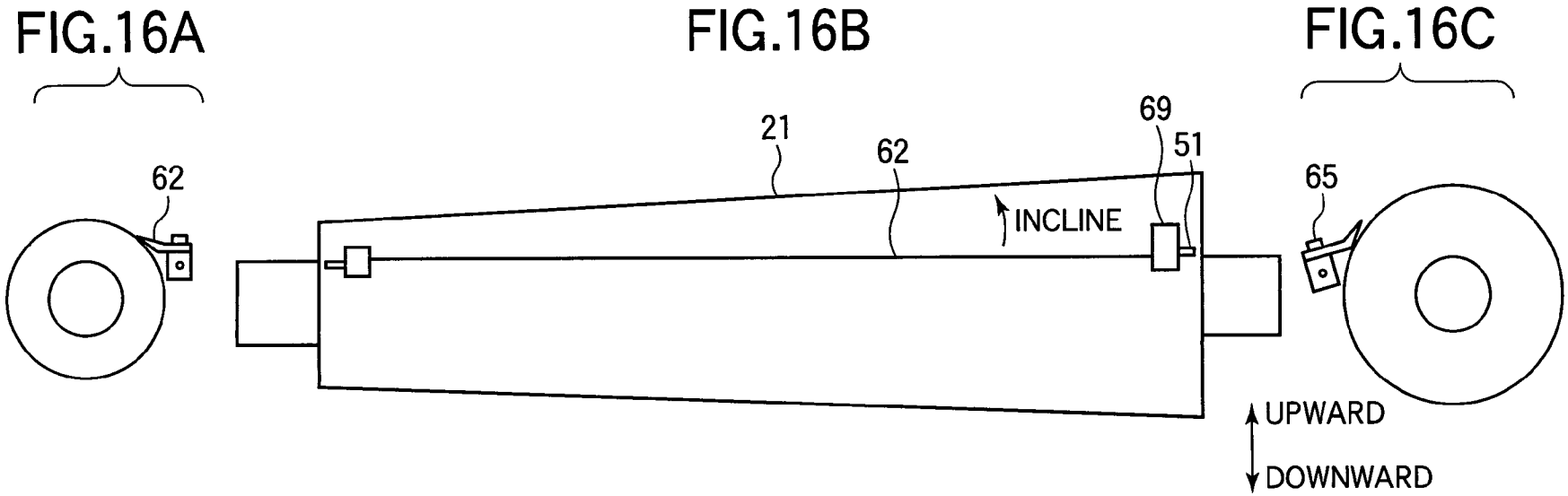
FIGS. 16A–16C illustrate the twisting of the fixing unit according to the third embodiment, FIG. 16A being a left side view, FIG. 16B being a front view, and FIG. 16C being a right side view.

FIGS. 16A–16C illustrate the twisting of the fixing unit, FIG. 16A being a left side view, FIG. 16B being a front view, and FIG. 16C being a right side view.

The upper and lower separators 57 and 62 are of similar configuration and therefore a description will be given of only the lower separator for simplicity's sake.

Referring to FIG. 14A and FIG. 14B, a plate-like holder 61 extends longitudinally immediately under the lower separator 62 to support the lower separator 62. The holder 61 and the lower separator 62 are assembled together in an integral assembly and have elongated holes 61*a* and 62*a* formed at their longitudinal end portions, respectively, the elongated holes 61*a* and 62*a* extending in directions shown by arrows E in FIGS. 14A and 14B. A left post 65 is fixed to a bracket 63 and a right post 66 is fixed to a right bracket 64. The left and right posts 65 and 66 extend into the elongated holes 61*a* and 62*a*. Washers and C rings are attached to the left and right posts 65 and 56, thereby preventing lower spacers 69 and 70 and the lower separator 62 from disengaging from the left and right posts 65 and 66. In this manner, the lower spacers 69 and 70 and lower separator 62 are assembled together while at the same time they are allowed to move along the left and right posts 65 and 66.

A fastening means such as bonding, bolting, or fitting may be employed as required to secure the holder 61 to the separator 62, the left bracket 63 to the left post 65, and the right bracket 64 to the right post 66.

A compression spring 67 fits over a projection 61*b* of the holder 61 and is held between a left end portion of the holder 61 and the left bracket 63 in a sandwiched relation. Likewise, a compression spring 68 fits over another projection (not shown) of the holder 61 and is held between a right end portion of the holder 61 and the right bracket 64 in a sandwiched relation. The compression springs 67 and 68 urge the separator 62 and holder 61 in a direction shown by arrow E against the lower spacers 69 and 70, respectively. The lower spacers 69 and 70 are pivotal about the post 51 mounted to side plates 52 and 53 (FIGS. 11 and 12). The lower spacers 69 and 70 are urged by torsion springs, not shown, similar to torsion springs 19 and 20 in FIG. 3 against the lower roller 21 just as in the first embodiment. Likewise, the upper spacers 58 and 59 are pivotal about posts 55 and 56 (FIG. 13), so that the upper spacers 58 and 59 are urged by the torsion springs, not shown, similar to torsion springs 19 and 20 in FIG. 3 against the upper roller 23. The upper spacers 58 and 59 are rotatable so that the upper spacers 58 and 59 are movable substantially in directions at an angle with the surface of the recording medium 24 or a direction of travel of the recording medium 24.

The fixing unit 163 of the aforementioned configuration will be described.

When the image-forming apparatus 100 is powered on and a printing operation is initiated, the recording medium 24 is advanced to the fixing unit 163 as shown in FIG. 15. If the recording medium 24 is about to become tacked to the upper roller 23, the upper separator 57 separates the recording medium 24 from the upper roller 23. If the recording medium 24 is about to become tacked to the lower roller 21, the lower separator 62 separates the recording medium 24 from the lower roller 21.

At this moment, in addition to the operation of the first embodiment, the small gaps between the lower spacers 69 and 70 and the lower separator 62 ensure a uniform gap between the lower separator 62 and the lower roller 21 across the length of the lower roller 21.

The left and right posts 65 and 66 firmly fit into the end portion of the holder 61 and extend through elongated holes 62*a* formed in the lower separator 62 and elongated holes 61*a* formed in the holder 61. C rings are mounted to the end portions of the left and right posts 65 and 66 in such a way that the lower separator 62 is vertically slightly movable. The elongated holes 62*a* and 61*a* extend in a direction parallel to the directions in which the compression springs 67 and 68 urge the lower separator 62 toward the lower roller 21. The lower separator 62 is also movable in the directions in which the elongated holes 62*a* and 61*a* extend. Thus, even when the lower roller 21 has a larger or smaller diameter at one longitudinal end than at the other longitudinal end due to thermal expansion, the compression springs 67 and 68 and the gaps between lower spacers 69 and 70 and the lower separator 62 cooperate with one another to prevent the lower separator 62 from being twisted. In this manner, a uniform gap between the lower roller 21 and lower separator 62 is maintained across the length of the lower roller 21. A longitudinal edge of the lower separator 62 still extends parallel to the longitudinal surface of the lower roller 21 and lies in the same plane as the rotational axis of the lower roller 21.

As described above, the lower separator 62 is assembled in an integral assembly with the holder 61 and supported such that the left and right longitudinal end portions of the separator 62 are independently movable relative to the lower roller 21. Thus, for example, even when thermal deformation of the lower roller 21 causes a difference in the diameter of the lower roller 21 between the longitudinal end portions of the lower roller 21, there is no situation where only one of the lower spacers 69 and 70 remains in contact with the roller 21. This provides reliable separation of the recording medium 24 from the lower roller 21.

Fourth Embodiment

Elements similar to those in the first to third embodiments have been given the same reference numerals and the description thereof is omitted.

Figure 17:
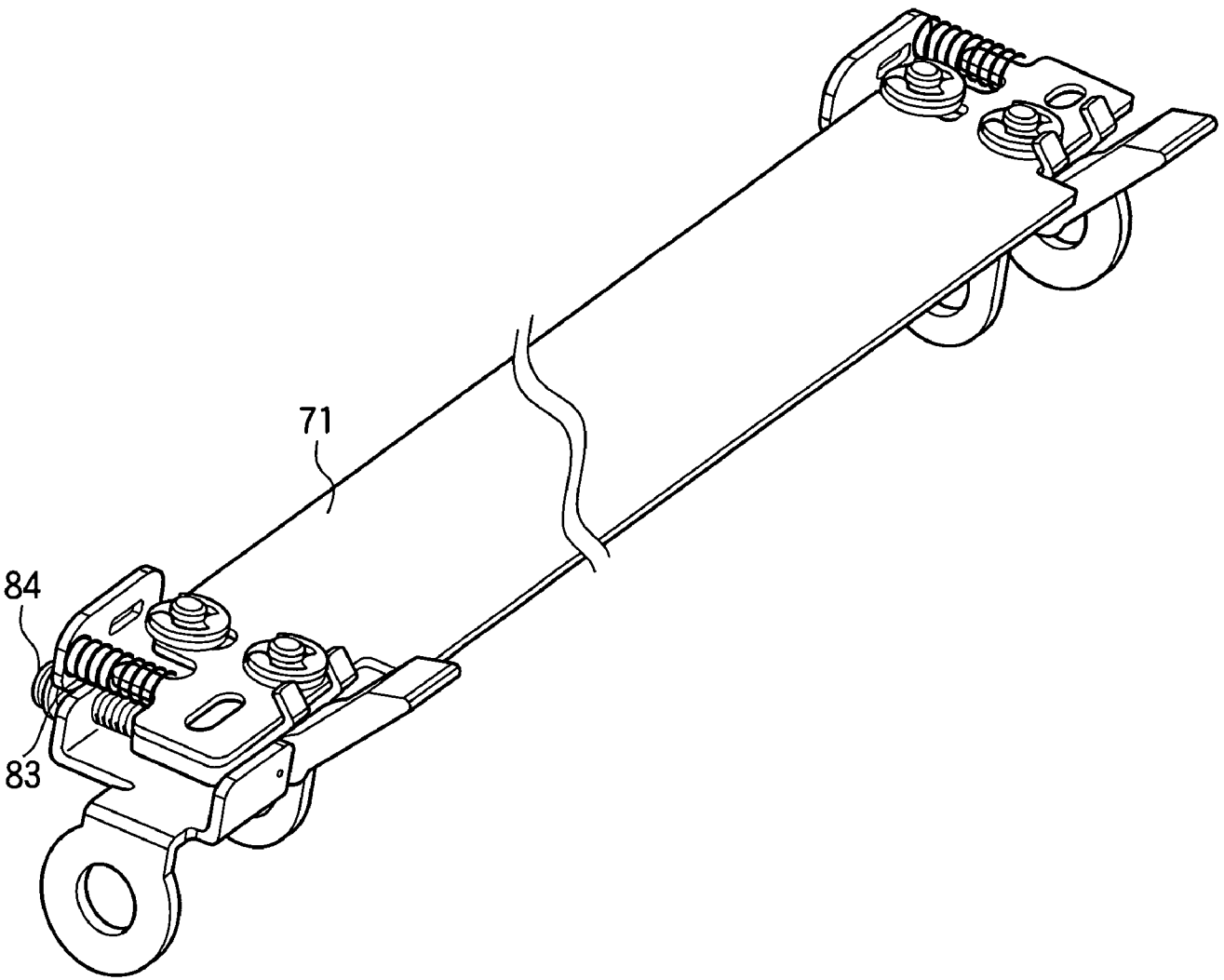
FIG. 17 is a perspective view of left and right end portions of the lower separator according to fourth embodiment.

FIG. 17 is a perspective view of left and right end portions of a lower separator 71.

Figure 18A:
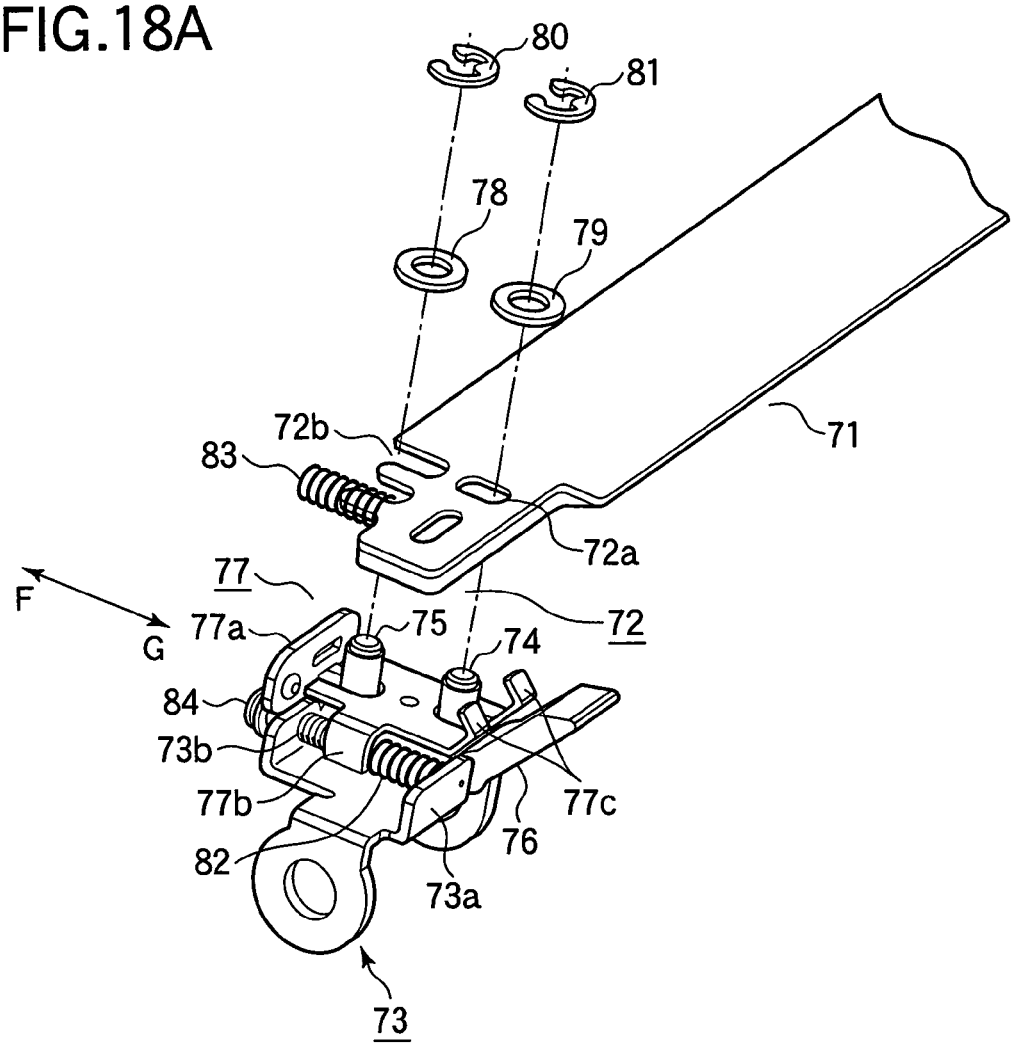
FIG. 18A is an exploded perspective view of a pertinent portion of the lower separator and a holder of FIG. 17.

FIG. 18A is an exploded perspective view of a pertinent portion of the lower separator 71 and a holder 72.

Figure 18B:
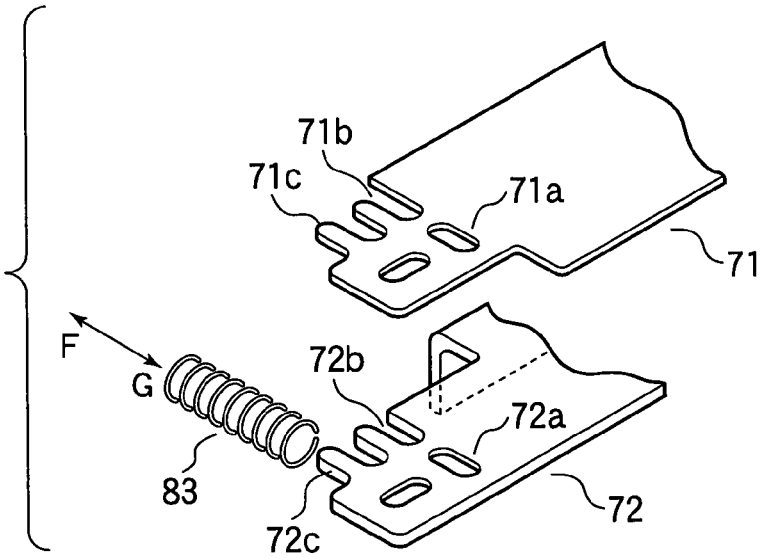
FIG. 18B is another exploded perspective view of the lower separator and the holder of the third embodiment.

FIG. 18B is another exploded perspective view of the lower separator 71 and a holder 72.

The upper and lower separators according to the fourth embodiment are of the same configuration and therefore a description will be given of only the lower separator 71 for simplicity's sake.

Referring to FIG. 18A and FIG. 18B, the lower separator 71 has an elongated hole 71*a*, a projection 71*c*, and U-shaped cutout 71*b*, which are formed in each of the longitudinal end portions of the lower separator 71. A holder 72 has an elongated hole 72*a*, a projection 72*c*, and U-shaped cutout 72*b*, which are formed in each of the longitudinal end portions of the holder 72. The holder 72 and lower separator 71 are assembled in an integral assembly. Posts 74 and 75 and a lower spacer 76 are secured to a bracket 73. The bracket are rotatable about a hole 73*c* in such a way that the lower spacer 76 moves substantially in direction at an angle with a direction of travel of the recording medium 24. The posts 74 and 75 extend through elongated holes formed in a slider 77 mounted on the spacer 76 such that the slider 77 is slidable in directions shown by arrows F and G. Washers 78 and 79 are mounted on the posts 74 and 75 from above the lower separator 71 and then E rings 80 and 81 are mounted on the posts 74 and 75.

A compression spring 82 is mounted between an angled portion 73*a* of the bracket 73 and an angled portion 77*b* of the slider 77, urging the slider 77 in a direction shown by arrow F in FIG. 18A relative to the bracket 73. A compression spring 83 is mounted between an angled portion 77*a* and the holder 72, and urges the holder 72 and lower separator 71 in a direction shown by arrow G against tongues 77*c* of the slider 77.

The angled portion 73*b* has a threaded hole formed therein. A bolt 84 is threaded into the threaded hole in the angled portion 73*b* in the G direction in FIG. 18A until the bolt 84 abuts the angled portion 77*b*. Referring to FIG. 18A, screwing the bolt 84 in the forward direction causes the slider 77 to slide in the direction shown by arrow G, and screwing the bolt 84 in the reverse direction causes the slider 77 to slide in the direction shown by arrow F. In other words, the bolt 84, slider 77, and compression spring 82 cooperate to serve as an adjustment mechanism in which the bolt 84 is operated to adjust the position of the slider 77 in the direction shown by arrows G and F.

The operation of the fixing unit 163 of the aforementioned configuration will be described.

The present embodiment allows adjusting of the relative position between the lower separator 71 and the lower spacer 76 at longitudinal end portions. Therefore, a proper amount of gap between the lower roller 21 and lower separator 71 can be ensured across the lower separator 71 for reliable separation of the recording medium 24 from the lower roller 21. An upper separator, not shown, is of the same configuration as the lower separator 71. Thus, a proper amount of gap between the upper separator and the upper roller 23 can be maintained for reliable separation of the recording medium 24 from the upper roller 23.

Fifth Embodiment

Elements similar to those in the first to fourth embodiments have been given the same reference numerals and the description thereof is omitted.

Figure 19:
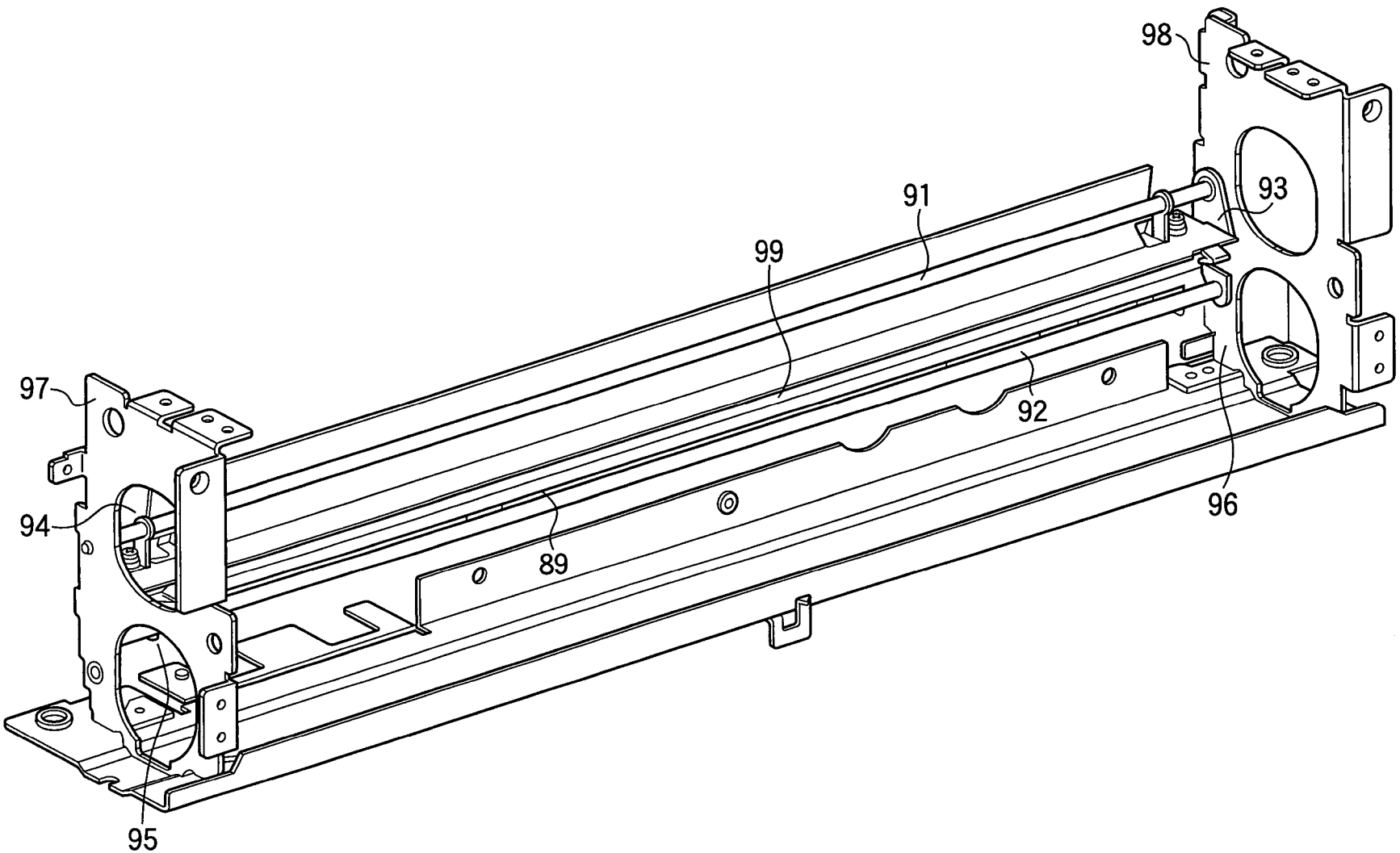
FIG. 19 is a perspective view of a fixing unit according to a fifth embodiment when an upper roller and a lower roller are dismounted.

FIG. 19 is a perspective view of a fixing unit 163 according to a fifth embodiment when an upper roller 23 and a lower roller 21 are dismounted from the fixing unit 163.

Referring to FIG. 19, a shaft 91 extends through brackets 93 and 94 and is secured to side plates 97 and 98 so that an upper separator 99 is rotatably supported on the shaft 91 via the brackets 93 and 94.

Likewise, a shaft 92 extends through brackets 95 and 96 and is secured to side plates 97 and 98 so that a lower separator 89 is rotatably supported on the shaft 92 via the brackets 95 and 96.

The operation of the fixing unit 163 of the aforementioned configuration is the same as the first and third embodiment and the description thereof is omitted.

In the fifth embodiment, the brackets 93 and 94 and brackets 95 and 96 rotate on the shafts 91 and 92, respectively, the brackets 93–96 restrict the lateral movement of the upper separator 99 and lower separator 89 along the shafts 91 and 92. Thus, a uniform gap can be maintained between the upper separator 99 and the upper roller 23 across the upper separator 99, and a uniform gap can be maintained between the lower separator 89 and the lower roller 21 across the lower separator 89. The uniform gaps provide reliable separation of the recording medium 24 from the upper and lower rollers 23 and 21.

Sixth Embodiment

Elements similar to those in the first to fifth embodiments have been given the same reference numerals and the description thereof is omitted.

Figure 20A:
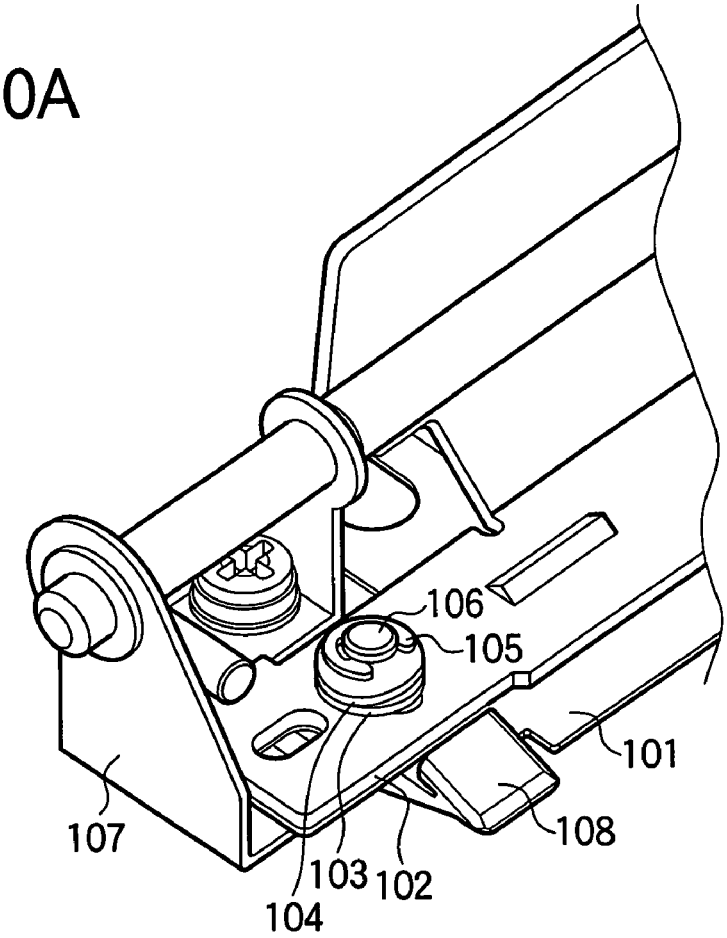
FIG. 20A is a fragmentary perspective view of a pertinent portion of a lower separator according to a sixth embodiment.

FIG. 20A is a fragmentary perspective view of a pertinent portion of an upper separator 101 according to a sixth embodiment.

Figure 20B:
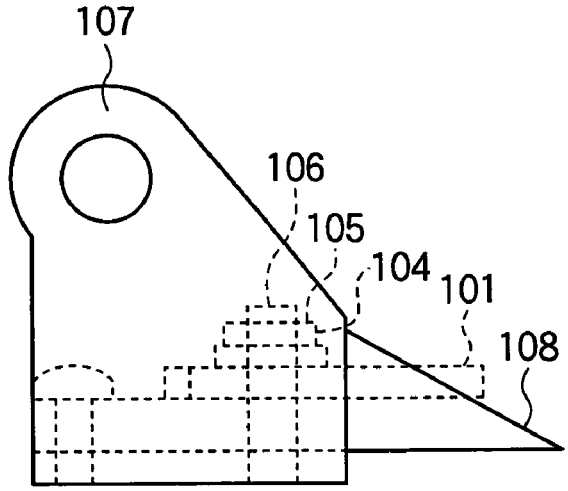
FIG. 20B is a side view of a pertinent portion of the lower separator according to the sixth embodiment.

FIG. 20B is a side view of a pertinent portion of the upper separator 101.

Referring to FIG. 20A and FIG. 20B, a post 106 is secured to a bracket 107 and extends through the upper separator 110. The bracket 107 supports the upper spacer 108 from under and is secured to the upper spacer 108. The upper separator 101 and the holder 102 are assembled in an integral assembly by using an adhesive, and mounted on the upper spacer 108. A washer 104 and an E ring 105 are mounted on a free end portion of the post 106.

The fixing unit 163 of the aforementioned configuration operates in the same manner as the first embodiment and the third to fifth embodiments, and therefore the description thereof is omitted.

In the sixth embodiment, the upper separator 101 is mounted in such a way that it is slightly movable vertically in a direction in which the post 106 extends. A wave washer 104 is mounted between the washer 103 and the E ring 105 so that the wave washer 104 absorbs gaps among the E ring 105, washer 103, and holder 102. This ensures a reliable gap between the upper separator 101 and the upper roller 23 for reliable separation of the recording medium 24 from the upper roller 23. A lower separator, not shown, is of the same configuration as the upper separator 101, so that a proper amount of gap is maintained between the upper separator 101 and the upper roller 23 for reliable separation of the recording medium 24 from the upper roller 23.

The use of the wave washer 104 can absorb unwanted small gaps among the structural members to ensure a predetermined amount of gap between the upper roller 23 and the upper separator 101 across the length of the upper roller 23. This in turn ensures reliable separation of the recording medium 24 from the upper roller 23.

Seventh Embodiment

In the first to sixth embodiments, the upper and lower separators are in the form of a single long plate that extends across the width of the transport path of the recording medium 24. The gap between the lower separator and the lower roller 21 and the gap between the upper separator and the upper roller 23 should be selected by taking into account that the lower roller 21 and upper roller 23 deform in their middle portions. In a seventh embodiment, the lower separator and upper separator have cutouts 41*b* and 42*b* (FIG. 24) formed in the middle portions thereof. The cutouts 41*b* and 42*b* allow reliable separation of the recording medium 24 from the lower roller 21 and upper roller 23 even when the lower roller 21 and upper roller 23 deform at their middle portions.

In the seventh embodiment, elements similar to those in the first to sixth embodiments have been given the same reference numerals and the description thereof is omitted.

Figure 21:
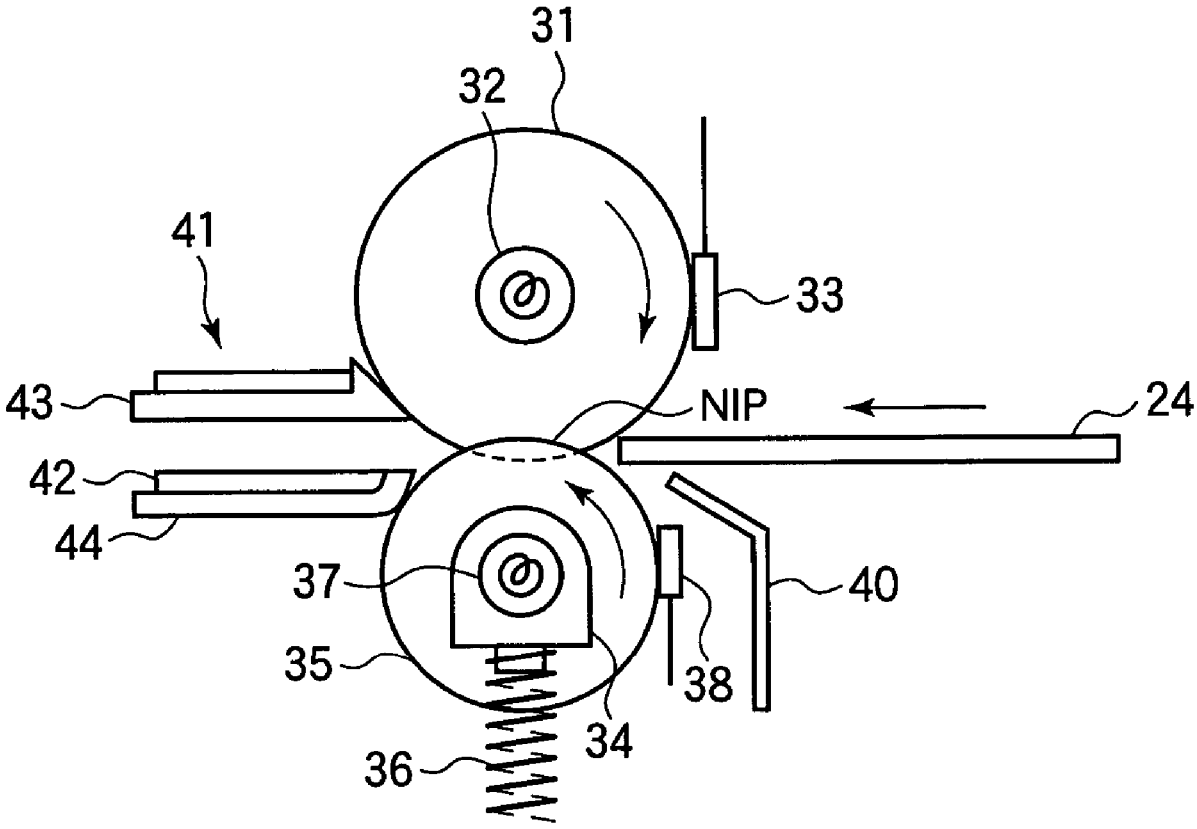
FIG. 21 is a side view of a fixing unit according to a seventh embodiment.

FIG. 21 is a side view of a fixing unit according to the seventh embodiment.

Figure 22:
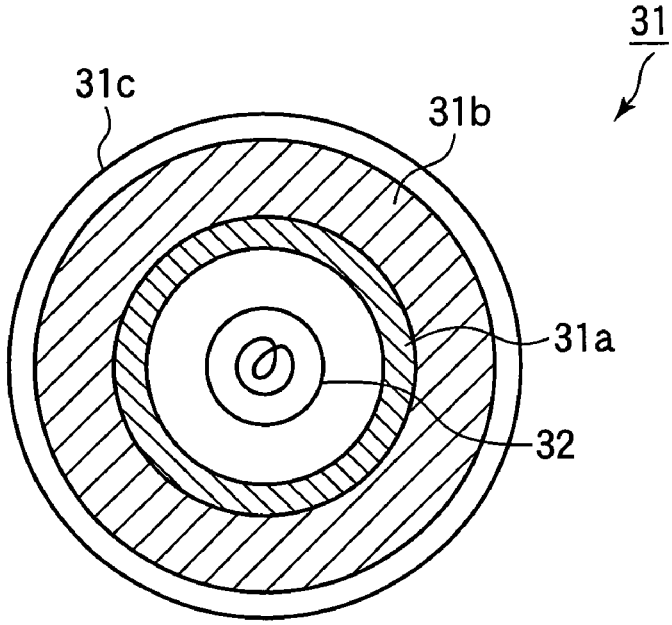
FIG. 22 is a cross-sectional side view of an upper roller of FIG. 21.

FIG. 22 is a cross-sectional side view of an upper roller 31.

Referring to FIG. 21, the upper roller 31 is a heating member that fuses toner on the recording medium 24 and is driven in rotation by a drive motor, not shown, through a drive gear, not shown, mounted to one end of the upper roller 31.

The upper roller 31 has a silicon rubber roller 31*b* formed on an aluminum pipe 31*a*. The silicone rubber roller 31*b* has a coating 31*c* thereon. The coating 31*c* is formed primarily of fluorocarbon resin that improves the separation of the recording medium 24 from the upper roller 31.

The aluminum pipe 31*a* incorporates a halogen lamp 32 therein that can be controlled on and off by a power supply, not shown. A thermistor 33 is in contact with the surface of the upper roller 31 and detects the surface temperature of the upper roller 31 to turn on an off the halogen lamp 32.

Figure 23:
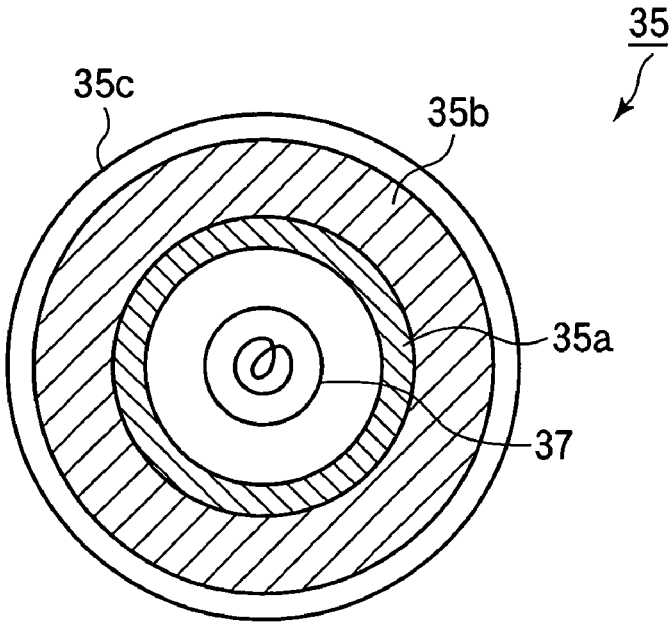
FIG. 23 is a cross-sectional side view of a lower roller of FIG. 21.

FIG. 23 is a cross-sectional side view of a lower roller 35.

Figure 24:
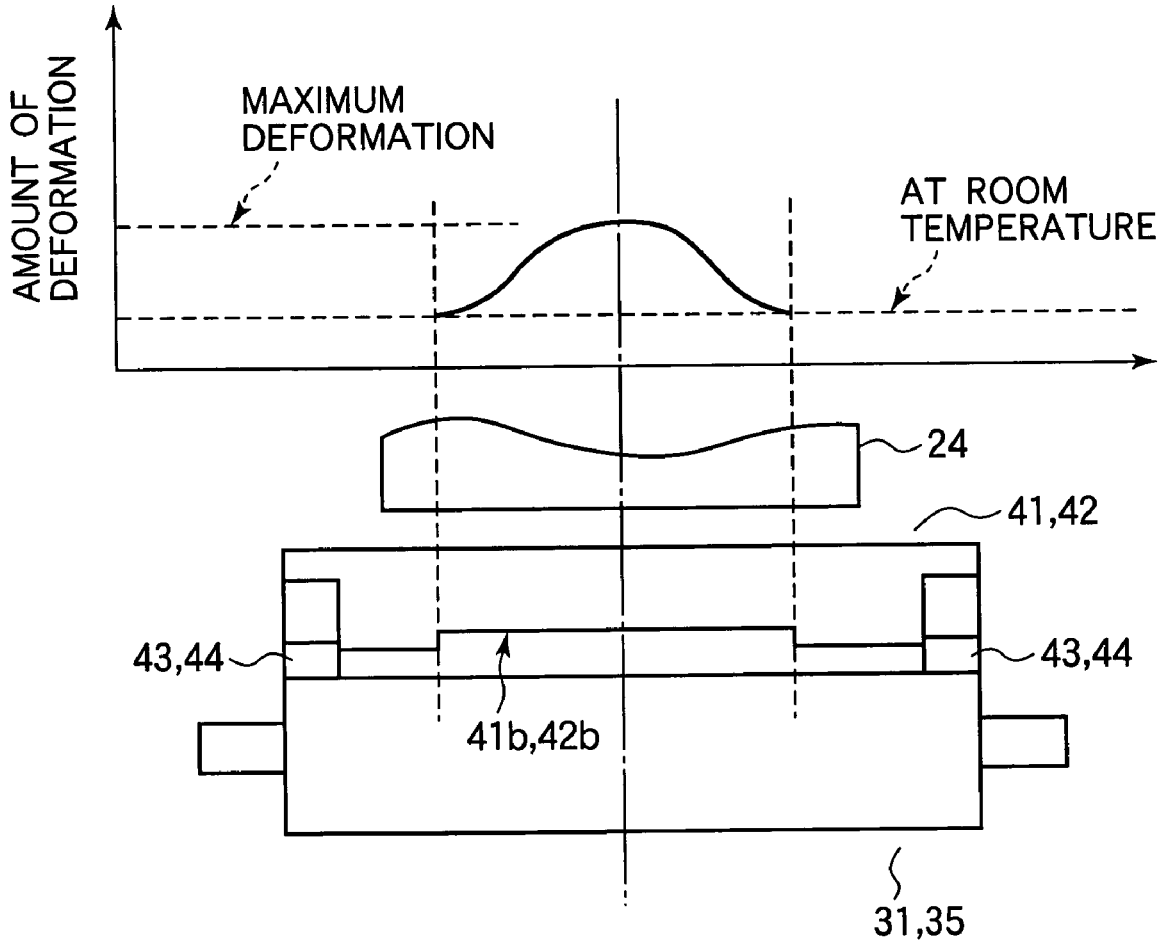
FIG. 24 illustrates amounts of gap between an upper separator and an upper roller, and amounts of gap between a lower separator and a lower roller.

FIG. 24 illustrates amounts of gap between an upper separator 41 and the upper roller 31, and gap between a lower separator 42 and the lower roller 35.

The lower roller 35 is disposed under the upper roller 31 and is in pressure contact with the upper roller 31 under a predetermined pressure. The lower roller 35 has a silicone rubber roller 35*b* formed on an aluminum pipe 35*a*. The silicone rubber roller 35*b* has a coating 35*c* formed thereon. The coating 35*c* is primarily formed of fluorocarbon resin that improves separation of the recording medium 24.

The aluminum pipe 35*a* of the lower roller 35 is rotatably supported at its both longitudinal end portions by bearings 34. The bearings 34 are supported by compression springs 36. The lower roller 35 is urged against the upper roller 31 under a predetermined pressure.

The upper roller 31 and lower roller 35 have silicone rubber rollers 31*b* and 35*b*, respectively. When the lower roller 35 is urged by the compression coil springs 36 against the upper roller 31, the silicone rubber rollers 31*b* and 35*b* deform to create a nip between them.

As shown in FIG. 23, the aluminum pipe 35*a* also incorporates a halogen lamp 37 therein, which can be controlled on and off by a power supply, not shown. A thermistor 38 (FIG. 21) is in contact with the surface of the lower roller 31 and detects the surface temperature of the lower roller 35 to turn on an off the halogen lamp 37.

As described above, the upper roller 31 and lower roller 35 have the silicone rubber rollers 31*b* and 35*b* formed on the aluminum pipes 31*a* and 35*a*, respectively. Thus, the upper roller 31 and lower roller 35 are not rigid but resilient.

The silicone rubber roller 35*b* is higher in hardness than the silicone rubber roller 31*b*, so that the surface of the upper roller 31 is dented while the surface of the lower roller 35 remains substantially cylindrical.

A front guide 40 is disposed upstream of the lower roller 35 with respect to the direction of travel of the recording medium 24, and guides the recording medium 24 toward the nip formed between the upper roller 31 and lower roller 35. An upper separator 41 and a lower separator 42 are disposed downstream of the upper roller 31 and lower roller 35 with respect to the direction of travel of the recording medium 24.

The upper separator 41 extends along the upper roller 31 and is a substantially rectangular metal plate coated with fluorine that prevents toner deposition thereon. The upper spacers 43 are disposed at both longitudinal end portions of the upper separator 41 and outside of the width of a maxim size recording medium 24 that passes through the nip between the upper roller 31 and lower roller 35. The upper spacers 43 are urged against the upper roller 31 by a predetermined urging force.

The lower separator 42 extends along the lower roller 35 and is a substantially rectangular metal plate coated with fluorine that prevents toner deposition thereon. The lower spacers 44 are disposed at both longitudinal end portions of the lower separator 42 and outside of the width of a maxim size recording medium 24 that passes through the nip between the upper roller 31 and lower roller 35. The upper spacers 43 are urged against the upper roller 31 by a predetermined urging force.

Both the upper separator 41 and lower separator 42 are in the form of a metal plate and have longitudinally centered cutouts 41*b* and 42*b* as shown in FIG. 24. The cutouts 41*b* and 42*b* extend over a distance shorter than the width of the recording medium 24.

Because the upper separator 41 and lower separator 42 in the form of metal plates extend along a heat-generating roller such as the upper and lower rollers 31 and 35, they tend to deform due to the heat radiated from the upper roller 31 and lower roller 35 as shown by the graph in FIG. 24. Referring to FIG. 24, a maximum thermal deformation occurs in a longitudinally middle portion of the upper separator 41 and lower separator 42. The thermal deformation of the upper separator 41 and lower separator 42 is smaller nearer the upper spacers 43 and lower spacers 44, respectively.

The operation of the fixing unit 163 of the aforementioned configuration will be described.

Upon a power-on command from a power supplying means, not shown, the halogen lamps 32 and 37 incorporated in the aluminum pipes 31*a* and 35*a* generate heat to raise the surface temperatures of the upper roller 31 and lower roller 35, respectively. The thermistors 33 and 38 detect the surface temperatures at all times and the halogen lamps 32 and 37 are controlled to turn on and off, thereby maintaining the surface temperatures of the upper and lower rollers 31 and 35 within a predetermined range.

When the surface temperatures of the upper and lower rollers 31 and 35 fall in a predetermined temperature range, a drive motor, not shown, runs to operatively rotate the upper roller 31 through a gear train in a direction shown by an arrow in FIG. 21. Subsequently, the lower roller 35 urged by the compression coil springs 36 against the upper roller 31 is driven in rotation by the upper roller 31.

The halogen lamps 32 and 37 heat the upper and lower rollers 31 and 35, which in turn heat the upper and lower separators 41 and 42. Thus, the upper and lower separators 41 and 42 are subjected to thermal deformation so that their longitudinally middle portions extend toward the upper and lower rollers 31 and 35, respectively.

Because of the cutouts 41*b* and 42*b*, the upper separator 41 and lower separator 42 are a predetermined distance (e.g., 0.3 to 1.0 mm) further away from the upper and lower rollers 31 and 35 at the longitudinally middle portions than at the longitudinal end portions. This predetermined distance is selected to be equivalent to an amount of thermal deformation of the upper separator 41 and lower separator 42. Thus, even when the upper and lower separators 41 and 42 deform due to heat radiated from the upper and lower rollers 31 and 35, there are still a clearance between the longitudinally middle portion of the upper separator 41 and the upper rollers 31 and a clearance between the longitudinally middle portion of the lower separator 42 and the lower roller 35. This structure eliminates the need for mounting the upper and lower separators 41 and 42 away from the upper and lower rollers 31 and 35 more than necessary, thereby preventing inadvertent contact of the upper and lower separators 41 and 42 with the upper and lower rollers 31 and 35, respectively.

When the upper and lower rollers 31 and 35 start rotating, the front guide 40 guides the recording medium 24 into the nip formed between the upper and lower rollers 31 and 35. The toner image on the recording medium 24 is fused by heat under pressure as the recording medium 24 passes through the nip. The toner acts as an adhesive that causes the recording medium 24 to become tacked to a coating 31*c* of the upper roller 31.

Because there are only small clearances between the upper separator 41 and upon roller 31 and between the recording medium 24 and upper roller 35, the recording medium 24 will not become tacked to the upper roller 31 and lower roller 35 but pass between the upper separator 41 and lower separator 42 into the stacker 166 located outside of the image-forming apparatus 100.

In particular, if the image-forming apparatus 100 has been designed to accept A3 size paper, the upper separator 41 and lower separator 42 only need to be controlled in flatness and parallelism at their longitudinal end portions. This alleviates requirements imposed on the components of the apparatus, thereby increasing yield of the components as well as reducing manufacturing costs.

Eighth Embodiment

The rectangular plate-like separators 41 and 42 have a large area that may contact the recording medium 24 when the recording medium 24 passes through the fixing unit 24, adversely affecting print quality. To prevent such a problem, the separators according to an eighth embodiment is adapted to incline at different angles according to the type of the recording medium 24, thereby preventing the separators from contacting the recording medium 24.

Elements similar to those in the first to seventh embodiments have been given the same reference numerals and the description thereof is omitted.

Figure 25:
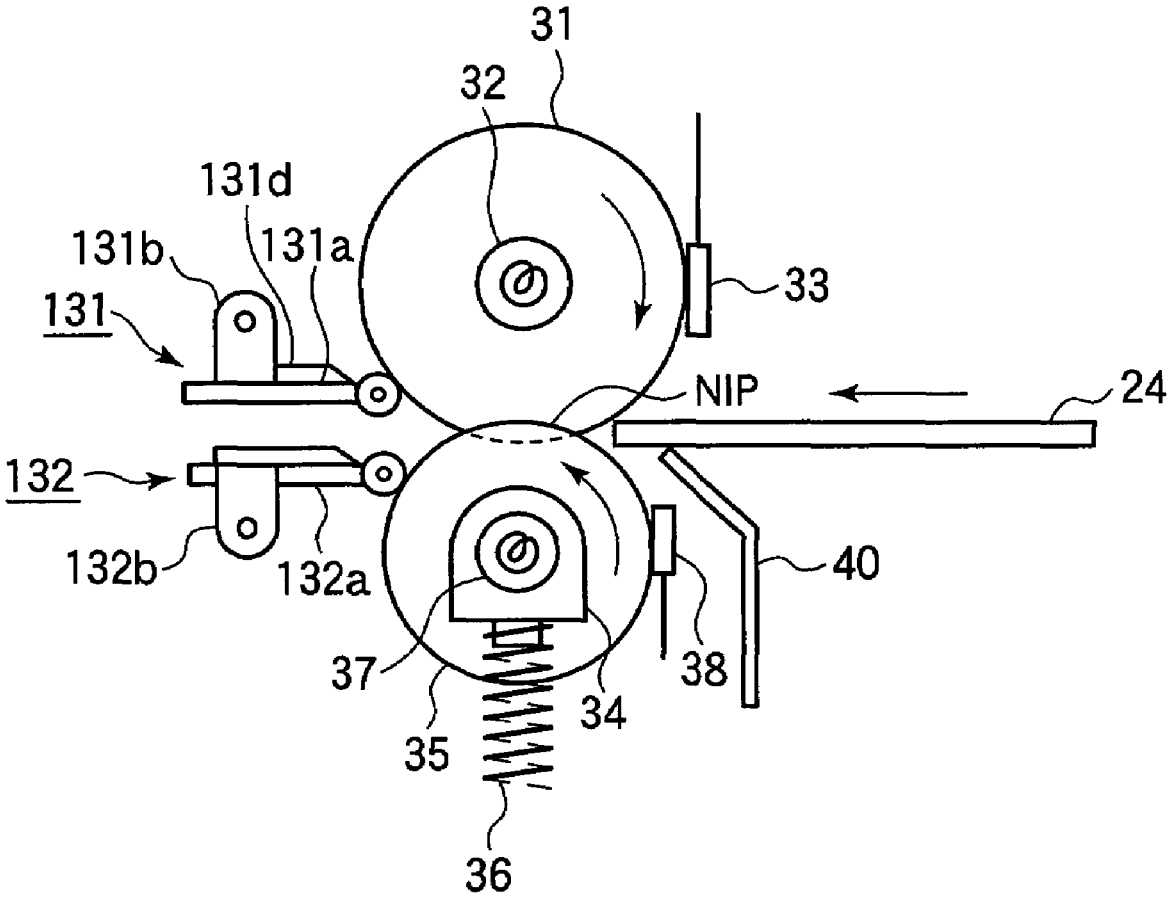
FIG. 25 is a side view of a fixing unit according to an eighth embodiment.

FIG. 25 is a side view of a fixing unit 163 according to an eighth embodiment.

Referring to FIG. 25, an upper separator 131*d* and lower separator 132*d* are disposed downstream of the upper roller 31 and the lower roller 35 with respect to the direction of travel of the recording medium 24.

The upper separator 131 has an upper spacer 131*a* attached to each of longitudinal end portions of the upper separator 131*d*. A spring, not shown, exerts a force that causes the upper separator 131*d* to pivot about a shaft 131*b*, so that the upper spacer 131*a* is brought into contact with the upper roller 31 under a predetermined pressure.

The lower separator 132*d* has a lower spacer 132*a* attached to each of the longitudinal end portions. A spring, not shown, exerts a force that causes the lower separator 132*d* to pivot about a shaft 132*b* so that the lower spacer 132*a* is brought into contact with the lower roller 35 under a predetermined pressure.

Figure 26:
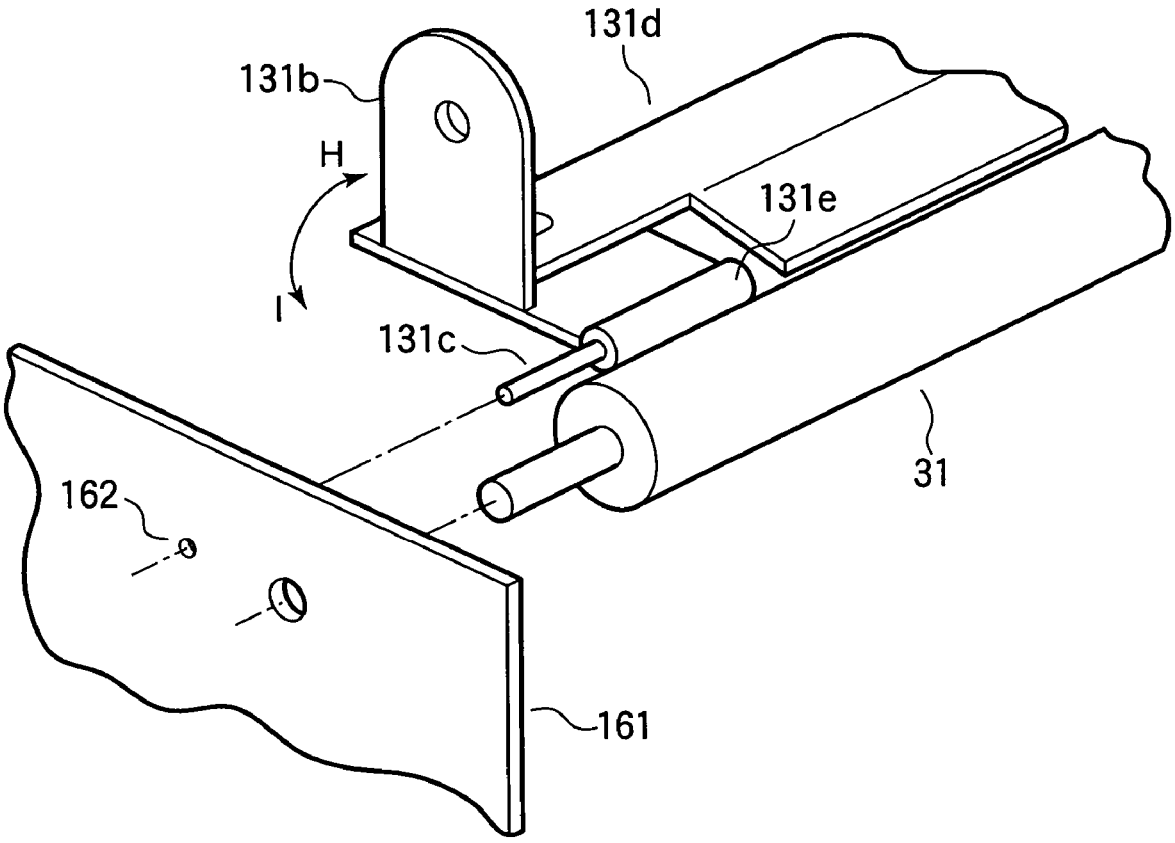
FIG. 26 is a perspective view of an inclining mechanism of a separator according to the eighth embodiment.

FIG. 26 is a perspective view of an inclining mechanism of a separator.

Referring to FIG. 26, the upper spacer 131*a* has a cylindrical end portion 131*e* with a shaft 131*c* in line with a longitudinally extending edge of the upper spacer 131*a*. The shaft 131*c* extends into a bearing hole 162 formed in a side frame 161 so that the upper separator 131*e* can pivot about the shaft 131*c* in directions shown by arrows H and I. When the upper separator 131*d* is driven by a mechanism (FIG. 27B) to move, the cylindrical end portion 131*e* slides on the circumferential surface of the upper roller 31 so that the a predetermined amount of gap is maintained between the upper roller 31 and the upper separator 131*d*. The lower spacer 132*a* has the same structure as the upper spacer 131*a* and operates the same way as the upper spacer 131*a* and therefore the description thereof is omitted.

Figure 27A:
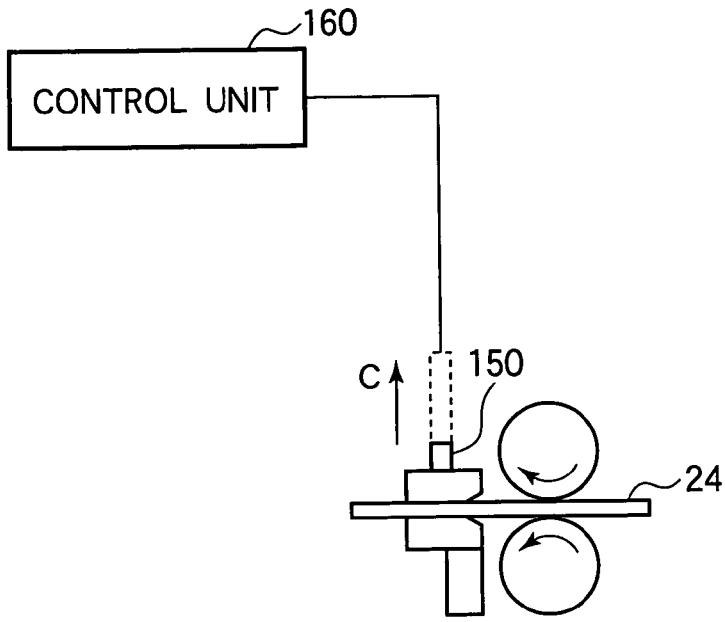
FIG. 27A illustrates a controller and a thickness sensor according to the eighth embodiment.

FIG. 27A illustrates a controller 160 and a thickness sensor 150. When the surface temperatures of the upper and lower rollers 31 and 35 fall in a predetermined temperature range, the recording medium 24 is fed from the paper cassette 157. The recording medium 24 fed from the paper cassette 157 pushes up a thickness sensor 150, which displaces correspondingly in an upward direction shown by an arrow C to detect the thickness of the recording medium 24. The output of the thickness sensor 150 is sent to the control unit 160. Based on the output of the thickness sensor 150, the control unit 160 determines whether the recording medium 24 is ordinary paper or a transparency (OHP).

Figure 27B:
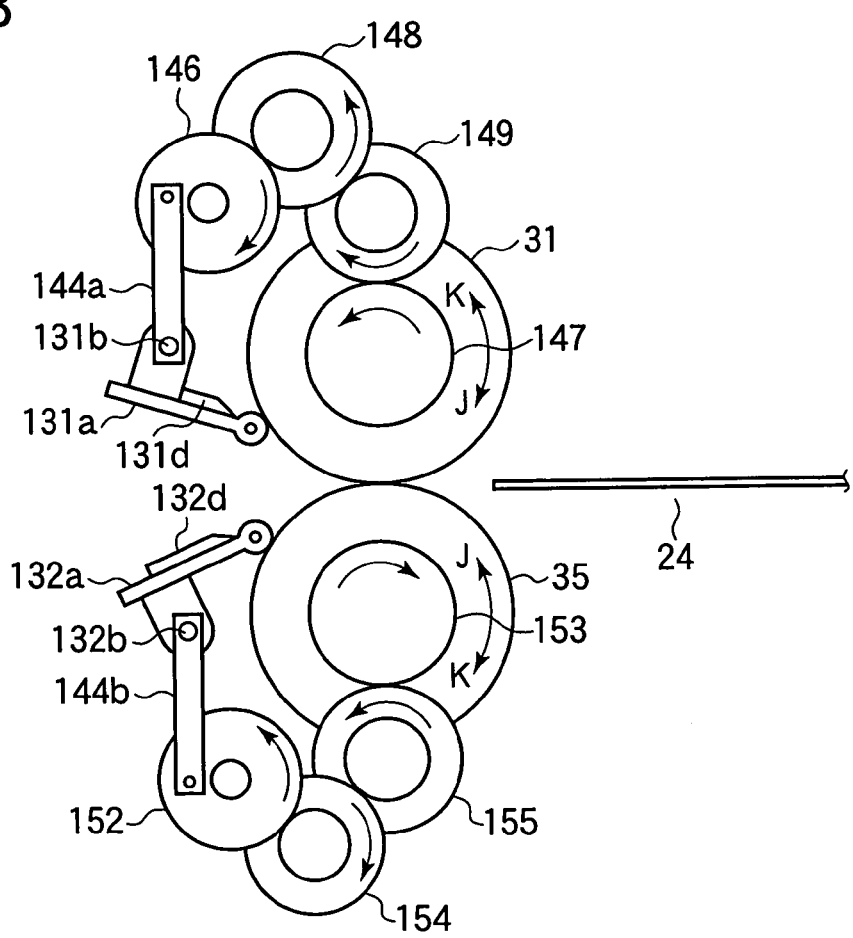
FIG. 27B illustrates the inclining mechanism according to the eighth embodiment.

FIG. 27B illustrates the inclining mechanism.

Referring to FIG. 27B, a shaft 133*a* and a gear 146 are coupled via a link 144*a*. The gear 146 is operatively coupled to the upper roller 31 via an idle gear 148, a one-way gear 149, and a gear 147. The gear 147 is concentric to the upper roller 31 and is driven by a main motor and a gear train, not shown. When the upper and lower rollers 31 and 35 rotate in directions shown by arrows J, the recording medium 24 is pulled in between the upper and lower rollers 31 and 35 for a normal fixing operation, and the one-way gears 149 and 155 do not transmit the rotation of the gears 147 and 153 to idle gears 148 and 154. When the upper and lower rollers 31 and 35 rotate in directions shown by arrows K, the one-way gears 149 and 155 transmit the rotation of the gear 147 and 153 to the idle gears 148 and 154 so that the idles gears 148 and 154 and the gears 146 and 152 rotate in the directions shown by arrows.

The operation of raising the upper separator and lower separator will be described.

When the recording medium 24 is fed from the paper cassette 157, a control unit 160 causes the main motor to rotate the gear 147, one-way gear 149, and idle gear 148 by a predetermined amount in directions shown by arrows depending on the thickness of the recording medium. Thus, the shaft 131*b* rotates to move the upper separator 131*d* upward.

A shaft 132*b* is coupled to the gear 152 via a link 144*b*. The gear 152 is operatively coupled to the lower roller 35 via the idle gear 154, one-way gear 155, and gear 153. The gear 153 is concentric to the lower roller 35 and is driven by the main motor and a gear train, not shown.

When the recording medium 24 is fed from the paper cassette 157, the control unit 160 causes the main motor to rotate the gear 152, one-way gear 155, and idle gear 154 by a predetermined amount in directions shown by arrows depending on the thickness of the recording medium 24. Thus, the shaft 133*b* rotates to move the lower separator 132 upward.

The operation of the fixing unit of the aforementioned configuration will be described.

Upon receiving a power-on command from a power supplying means, not shown, the halogen lamps 32 and 37, incorporated in the aluminum pipes 31*a* and 35*a* of the upper roller 31 and lower roller 35, respectively, generate heat to raise the surface temperature of the upper roller 31 and lower roller 35, respectively. The thermistors 33 and 38 detect the surface temperatures of the upper roller 31 and lower roller 35 at all times and the halogen lamps 32 and 37 are controlled to turn on and off, thereby maintaining the upper and lower rollers 31 and 35 within a predetermined temperature range.

When the surface temperatures of the upper and lower rollers 31 and 35 fall in a predetermined temperature range, a drive motor, not shown, runs to operatively rotate the upper roller 31 through a gear train in directions shown by arrows J in FIG. 27B. Subsequently, the lower roller 35 urged by the compression coil springs 36 against the upper roller 31 is driven in rotation by the upper roller 31.

If it is determined that the recording medium 24 is a transparency, the control unit 160 causes the main motor to rotate by a predetermined amount in the reverse direction, so that the upper separator 131*d* moves upward and the lower separator 132*d* moves downward. Thus, the gears 147 and 153, one-way gears 149 and 155, idle gears 148 and 154, and gears 146 and 152 rotate by a predetermined amount in directions shown by arrows in FIG. 27B, thereby. adjusting the angle of the separator in relation to the fixing roller.

When the upper separator 131*d* and the lower separator 132*d* are to be moved back to their original positions, the main motor and the gear mechanism further rotate by a predetermined amount in the reverse direction. The one way gears 149 and 155 transmit the rotation of the gears 147 and 153 to the gear 148 and 154 when the main motor rotates in the reverse direction and does not when the main motor rotates in the forward direction. The one way gears may be omitted if the gears 147 and 153 are allowed to rotate independently of the upper roller 31 and lower roller 35, respectively.

Because the upper separator 131*d* and lower separator 132*d* can be inclined, a special recording medium such as transparency will be transported to the outside of the image-recording apparatus without touching the upper separator 131 after passing the nip.

This prevents variations in transmission of light that passes through the OHP and the gloss of the thin media that would otherwise occur when the upper and lower separators 131*d* and 132*d* inadvertently touch the recording medium 24.

The spacers are rotatable about an axis regardless of the changes in the diameter of rollers and in contact with the rollers close to the nip formed between the upper roller and the lower roller. Thus, the spacers can rotate or pivot about the axis in accordance with the changes in the diameter of the rollers, thereby maintaining a substantially constant gap between the rollers and the separators across the length of the separators.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fixing apparatus comprising:

a fixing member heated while rotating, said fixing member being in pressure contact with an advancing recording medium to fuse developer deposited on the recording medium;

plates disposed at either end of the fixing member;

a guiding member disposed to oppose said fixing member and extending across a path of the recording medium having the fused developer thereon, said guiding member guiding the recording medium to separate from said fixing member;

spacers disposed outside of the path and supporting said guiding member thereon in such a way that a gap is defined between said guiding member and said fixing member across the path, said spacers being rotatable about first posts formed on said plates so that said spacers are displaceable relative to the recording medium; and a first urging member mounted to at least one of the first posts that urges said spacers against said fixing member.

2. The fixing apparatus according to claim 1, wherein said fixing member rotates about a first axis and spacers are rotatable about a second axis substantially parallel to the first axis.

3. The fixing apparatus according to claim 2, wherein said spacers are rotatable about the second axis independently.

4. The fixing apparatus according to claim 3, wherein said guiding member is resilient.

5. The fixing apparatus according to claim 3, wherein said guiding member and said spacers are coupled in such a way that said guiding member is movable relative to said spacers.

6. The fixing apparatus according to claim 3, wherein said guiding member engages said spacers resiliently.

7. The fixing apparatus according to claim 3, wherein said guiding member is shaped to define a larger gap at the middle portion of said guiding member than at the longitudinal end portions of said guiding member.

8. The fixing apparatus according to claim 1, further comprising an adjustment mechanism that adjusts a positional relation between said guiding member and said spacers.

9. The fixing apparatus according to claim 1, further comprising an inclination adjustment mechanism that adjusts an angle of said guiding member relative to said fixing member.

10. The fixing apparatus according to claim 9, wherein said inclination adjustment mechanism operates to incline said guiding member while also maintaining the predetermined gap between said guiding and said fixing member.

11. An image forming apparatus incorporating the fixing apparatus according to claim 1, the apparatus further comprising:

an image-forming section that forms an image with a developer on a recording medium.

12. The fixing apparatus according to claim 1, wherein said spacers engage said guiding member in such a way that said guiding member is moveable relative to said spacers by an amount.

13. The fixing apparatus according to claim 1, further comprising a second urging member that urges said guiding member against said spacers.

14. The fixing apparatus according to claim 13, wherein said guiding member is formed with an elongated hole that extends in a direction substantially perpendicular to a rotational axis of said fixing member;

wherein said spacers are mounted to at least one bracket including a second post that engages the elongated hole, and the second urging member is mounted between said guiding member and the at least one bracket and presses said guiding member in the direction in which the elongated hole extends.

15. A fixing apparatus comprising:

a fixing member heated and is rotating about a first axis, said fixing member being in pressure contact with an advancing recording medium to fuse developer deposited on the recording medium;

plates disposed at either end of the fixing member;

a guiding member disposed to oppose said fixing member, said guiding member guiding the recording medium to separate from said fixing member;

spacers disposed outside of the path and supporting said guiding member thereon in such a way that a gap is defined between said guiding member and said fixing member, said spacers being rotatable on first posts formed on said plates independently of each other about a second axis substantially parallel to the first axis so that said spacers are displaceable relative to the recording medium; and a first urging member mounted to at least one of the first posts that urges said spacers against said fixing member.

16. The fixing apparatus according to claim 15, further comprising an adjustment mechanism that adjusts a positional relation between said guiding member and said spacers.

17. The fixing apparatus according to claim 15, further comprising an inclination adjustment mechanism that adjusts an inclination of said guiding member relative to said fixing member.

18. The fixing apparatus according to claim 17, wherein said inclination adjustment mechanism operates to incline said guiding member while also maintaining the predetermined gap between said guiding and said fixing member.

19. An image forming apparatus incorporating the fixing apparatus according to claim 15, the apparatus further comprising:

an image-forming section that forms an image with a developer on a recording medium.

20. The fixing apparatus according to claim 15, wherein said spacers engage said guiding member in such a way that said guiding member is moveable relative to said spacers by an amount.

21. The fixing apparatus according to claim 15, further comprising a second urging member that urges said guiding member against said spacers.

22. The fixing apparatus according to claim 21, wherein said guiding member is formed with an elongated hole that extends in a direction substantially perpendicular to a rotational axis of said fixing member;

wherein said spacers are mounted to at least one bracket including a second post that engages the elongated hole, and the second urging is mounted between said guiding member and the at least one bracket and presses said guiding member in the direction in which the elongated hole extends.

23. A fixing apparatus comprising:

a fixing member heated while rotating in pressure contact with an advancing recording medium to fuse developer deposited on the recording medium;

a guiding member disposed to oppose said fixing member and extending across a path of the recording medium having the fused developer thereon, said guiding member guiding the recording medium to separate from said fixing member;

spacers disposed outside of the path and supporting said guiding member thereon in such a way that a gap is defined between said guiding member and said fixing member across the path, said spacers being displaceable relative to the recording medium;

a first urging member that urges said spacers against said fixing member; and a second urging member that urges said guiding member against said spacers.

24. The fixing apparatus according to claim 23, wherein said guiding member is formed with an elongated hole that extends in a direction substantially perpendicular to a rotational axis of said fixing member;

wherein said spacers are mounted to at least one bracket including a second post that engages the elongated hole, and the second urging member is mounted between said guiding member and the at least one bracket and presses said guiding member in the direction in which the elongated hole extends.

25. The fixing apparatus according to claim 23, wherein said spacers are rotatable about an axis substantially parallel to a rotational axis of said fixing member, said spacers being rotatable independently of each other.

26. An image forming apparatus incorporating said fixing apparatus according to claim 23, comprising:

an image forming section that forms an image with a developer on a recording medium.

27. A fixing apparatus comprising:

a fixing member heated while rotating about a first axis, said fixing member being in pressure contact with an advancing recording medium to fine developer deposited an the recording medium;

a guiding member disposed to oppose said fixing member, said guiding member guiding the recording medium to separate from said fixing member;

spacers disposed outside of the path and supporting said guiding member thereon in such a way that a gap is defined between said guiding member and said fixing member, said spacers being rotatable independently of each other about a second axis substantially parallel to the first axis so that said spacers are displaceable relative to the recording medium;

a first urging member that urges said spacers against said fixing member; and a second urging member that urges said guiding member against said spacers.

28. The fixing apparatus according to claim 27, wherein said guiding member is fanned with an elongated hole that extends in a direction substantially perpendicular to a rotational axis of said fixing member;

wherein maid spacers are mounted to at least one bracket including a second post that engages the elongated hole, and the second urging member is mounted between said guiding member and the at least one bracket and presses said guiding member in the direction in which the elongated hole extends.

29. An image forming apparatus incorporating said fixing apparatus according to claim 27, comprising:

an image forming section that forms an image with a developer on a recording medium.

30. A fixing apparatus comprising:

a fixing member heated while rotating about a rotational axis in pressure contact with an advancing recording medium to fuse developer deposited on the recording medium;

plates disposed at either end of the fixing member;

a guiding member disposed to oppose said fixing member and extending across a path of the recording medium having the fused developer thereon, said guiding member having a tip that faces said fixing member to guide the recording medium to separate from said fixing member;

spacers disposed outside of the path and in contact with said fixing member, said spacers supporting said guiding member thereon in such a way that a gap is defined between said guiding member and said fixing member across the path, said spacers being rotatable about first posts formed on said plates in such a way that the tip and the rotational axis lie in a plane extending through an area in which said spacers are in contact with said fixing member; and an urging member mounted to at least one of the first posts and urging said spacers against said fixing member.

31. An image forming apparatus incorporating said fixing apparatus according to claim 30, comprising;

an image forming section that forms an image with a developer on a recording medium.

32. A fixing apparatus comprising:

a fixing member heated while rotating in pressure contact with an advancing recording medium to fuse developer deposited on the recording medium;

plates disposed at either end of to fixing member;

a guiding member disposed to oppose said fixing member and extending across a path of the recording medium having the fused developer thereon, said guiding member guiding the recording medium to separate from said fixing member;

spacers disposed outside of the path and in contact with said fixing member, said spacers being supporting said guiding member thereon in such a way that a gap is defined between said guiding member and said fixing member across the path, said spacers being rotatable about first posts formed on said plates in such a way that the first posts are positioned between a first plane tangent to a first area in a circumferential surface of said fixing member and a second plane tangent to the circumferential surface and parallel to the first plane, the recording medium advancing in contact with the first area; and an urging member mounted to at least one of the first posts and urging said spacers against said fixing member.

33. An image forming apparatus incorporating said fixing apparatus according to claim 32, comprising:

an image forming section that forms an image with a developer on a recording medium.

34. A fixing apparatus comprising:

a fixing member heated while rotating about a rotational axis in pressure contact with an advancing recording medium to fuse developer deposited on the recording medium;

plates disposed at either end of the fixing member;

a guiding member disposed to oppose said fixing member and extending across a path of the recording medium having the fused developer thereon, said guiding member having a tip that faces said fixing member to guide the recording medium to separate from said fixing member;

spacers disposed outside of the path and in contact with said fixing member, said spacers supporting said guiding member thereon in such a way that a gap is defined between said guiding member and said fixing member across the path, wherein said spacers are rotatable about first posts formed on said plates in such a way that the tip and the rotational axis lie in a plane extending through an area in which said spacers are in contact with said fixing member, wherein the first posts are positioned between a first plane tangent to a first area in a circumferential surface of said fixing member and a second plane tangent to the circumferential surface and parallel to the first plane; end an urging member mounted to at least one of the first posts and urging said spacers against said fixing member.

35. An image forming apparatus incorporating said fixing apparatus according to claim 34, comprising:

an image forming section that forms an image with a developer on a recording medium.

* * * * *